US010681944B2

(12) United States Patent
Hull

(10) Patent No.: US 10,681,944 B2
(45) Date of Patent: Jun. 16, 2020

(54) PROTECTIVE DEVICE FOR USE WITH A GLOVE

(71) Applicant: Summit Glove Inc., Minerva, OH (US)

(72) Inventor: James L. Hull, Malvern, OH (US)

(73) Assignee: Summit Glove Inc., Minerva, OH (US)

( * ) Notice: Subject to any disclaimer, the term of this patent is extended or adjusted under 35 U.S.C. 154(b) by 290 days.

(21) Appl. No.: 15/843,838

(22) Filed: Dec. 15, 2017

(65) Prior Publication Data

US 2018/0103700 A1 Apr. 19, 2018

Related U.S. Application Data

(63) Continuation of application No. 15/843,426, filed on Dec. 15, 2017, and a continuation of application No. 15/185,097, filed on Jun. 17, 2016, now Pat. No. 10,143,248, and a continuation of application No. 15/384,499, filed on Dec. 20, 2016, which is a continuation-in-part of application No. 14/624,047, filed on Feb. 17, 2015, now Pat. No. 9,888,733, which is a continuation-in-part of application No. 13/947,423, filed on Jul. 22, 2013, now abandoned.

(60) Provisional application No. 62/181,967, filed on Jun. 19, 2015.

(51) Int. Cl.

| | |
|---|---|
| ***A41D 13/08*** | (2006.01) |
| ***A41D 19/015*** | (2006.01) |
| ***A41D 19/00*** | (2006.01) |

(52) U.S. Cl.

CPC ..... *A41D 13/082* (2013.01); *A41D 19/0006* (2013.01); *A41D 19/01505* (2013.01); *A41D 19/01529* (2013.01); *A41D 19/01576* (2013.01)

(58) Field of Classification Search

CPC ..... A41D 13/081; A41D 13/082; A41D 19/0006; A41D 19/01505; A41D 19/01529; A41D 19/01576

USPC ..... 2/16

See application file for complete search history.

(56) References Cited

U.S. PATENT DOCUMENTS

| | | | |
|---|---|---|---|
| 1,483,595 | A | 2/1924 | Read |
| 1,625,999 | A | 4/1927 | Irish |
| 1,673,517 | A | 6/1928 | Kurz |
| 2,114,022 | A | 1/1935 | Jensen |
| 2,001,961 | A | 5/1935 | Jensen |
| 2,040,137 | A | 5/1936 | Jensen |
| 2,041,201 | A | 5/1936 | Neback |

(Continued)

OTHER PUBLICATIONS http://www.skis.com/Kombi-Glove-Protector---Kids-2013/11302P,default,pd.html—Kombi Glove Protector—Kids (online ski shop)—date printed: Apr. 16, 2013.

*Primary Examiner* — Alissa L Hoey

(74) *Attorney, Agent, or Firm* — Sand, Sebolt & Wernow Co., LPA

(57) ABSTRACT

A color splash effect is established by a darker backdrop color of an outer surface of a liquid proof and heat resistant glove in the event that a portion of the glove ruptures or fails. The color splash effect is accomplished by a lighter and brighter color being visible through the rupture in the glove. The lighter and brighter color may be formed on or as part of a protective member positioned beneath the outer layer. The protective member also protects the wearer against sharp objects contacting the outer layer of the glove and moving over the protective member. Some embodiments provide that the protective member is in a thumb crotch region of the glove.

13 Claims, 18 Drawing Sheets

(56) References Cited

U.S. PATENT DOCUMENTS 2,067,790 A 1/1937 Sager
2,067,791 A 1/1937 Sager
2,142,788 A 1/1939 Jensen
2,582,240 A 1/1952 Dumas
2,905,946 A 9/1959 Goldsmith
2,988,457 A 6/1961 Gatcomb
3,267,486 A 8/1966 Madnick
3,633,216 A * 1/1972 Schonholtz ..... A61B 42/10 2/168
4,001,895 A 1/1977 Cohen
4,032,990 A 7/1977 Madlman
4,061,709 A 12/1977 Miller et al.
4,172,293 A 10/1979 Vistins
4,433,439 A 2/1984 Sidman et al.
4,454,611 A 6/1984 Tschirch et al.
4,524,464 A 6/1985 Primiano et al.
4,658,441 A 4/1987 Smith
4,694,508 A 9/1987 Iriyama et al.
4,696,065 A 9/1987 Elenteny
4,742,578 A 5/1988 Seid
4,750,218 A 6/1988 Ziegler
4,779,289 A 10/1988 Prouty
4,779,290 A 10/1988 Welch et al.
4,785,479 A 11/1988 Watanabe
4,833,733 A 5/1989 Welch et al.
4,873,998 A 10/1989 Joyner
4,894,866 A 1/1990 Walker
4,910,803 A * 3/1990 Cukier ..... A41D 19/0058 128/844
4,942,626 A 7/1990 Stern et al.
4,987,611 A 1/1991 Maye
5,020,161 A 6/1991 Lewis, Jr. et al.
5,070,540 A 12/1991 Bettcher et al.
5,083,973 A 1/1992 Townsend
5,168,578 A 12/1992 Stanley
5,187,815 A 2/1993 Stern et al.
5,231,700 A 8/1993 Cutshall
5,345,608 A 9/1994 Mergens et al.
5,384,083 A 1/1995 Dawn et al.
5,402,536 A 4/1995 Matthews
5,561,856 A 10/1996 Pesco
5,564,127 A 10/1996 Manne
5,588,651 A 12/1996 Frost
5,598,582 A 2/1997 Andrews et al.
5,604,934 A 2/1997 Willett
5,629,039 A 5/1997 Brintle
5,685,014 A * 11/1997 Dapsalmon ..... A41D 19/01511 2/159
5,697,104 A 12/1997 Welton
D389,608 S 1/1998 Kraatz
5,745,919 A 5/1998 Kraatz
5,758,569 A * 6/1998 Barbour ..... A47J 37/1204 99/415
5,770,297 A 6/1998 Grubich
5,817,433 A 10/1998 Darras
5,822,791 A 10/1998 Baris
5,937,743 A 8/1999 Overstreet
5,988,048 A 11/1999 Hunter et al.
6,012,170 A 1/2000 Kim
6,021,523 A 2/2000 Vero
6,142,064 A * 11/2000 Backus ..... A47J 37/041 126/190
6,145,128 A 11/2000 Suzuki
6,260,203 B1 7/2001 Battle
6,314,869 B1 * 11/2001 Bourgeois, Jr. ..... A47J 33/00 99/340
6,341,376 B1 1/2002 Smerdon, Jr.
6,360,373 B1 3/2002 Rehn et al.
6,427,246 B1 8/2002 Doi et al.
6,449,772 B1 9/2002 Donner
6,457,182 B1 10/2002 Szczesuil et al.
6,539,552 B1 4/2003 Yoshida
6,721,960 B1 4/2004 Levesque et al.
6,760,924 B2 7/2004 Hatch et al.
6,973,675 B2 12/2005 Cheng
7,021,204 B2 4/2006 Backus et al.
7,062,791 B2 6/2006 Gold
7,089,600 B2 8/2006 Morita
D533,969 S 12/2006 Contant et al.
D537,211 S 2/2007 Contant et al.
7,377,566 B2 5/2008 Gazaui et al.
7,380,288 B1 6/2008 Duncan
7,383,590 B1 6/2008 Duncan
7,431,671 B1 10/2008 Frost
7,469,426 B2 12/2008 Roeckl
7,836,839 B2 11/2010 Park
7,963,864 B2 6/2011 Frost
8,104,097 B2 1/2012 Hamann
8,146,173 B2 4/2012 Kim
8,656,518 B2 2/2014 Saunders et al.
8,733,235 B1 5/2014 Chipman
8,852,033 B1 10/2014 Frost
8,863,317 B2 10/2014 Tsuru et al.
9,161,579 B1 10/2015 Johnson
9,266,263 B1 2/2016 Jaeger
9,549,579 B2 1/2017 Bailey
9,622,524 B2 4/2017 VanErmen et al.
9,888,733 B2 2/2018 Hull
10,349,690 B2 7/2019 Francisco Costa et al.
10,413,003 B2 9/2019 Kimbrough
10,420,382 B2 9/2019 Gellis
2003/0005828 A1 1/2003 McLemore et al.
2003/0079273 A1 5/2003 Genkins
2003/0134063 A1 7/2003 Vance et al.
2003/0140396 A1 7/2003 Vero et al.
2003/0179653 A1 9/2003 McLemore et al.
2004/0187189 A1 9/2004 Morita
2005/0005338 A1 1/2005 Lewis
2005/0028244 A1 2/2005 Roeckl
2005/0056633 A1 * 3/2005 Backus ..... A47J 37/041 219/392
2005/0284306 A1 * 12/2005 Backus ..... A47J 37/042 99/427
2006/0080757 A1 4/2006 Beyda
2006/0090771 A1 5/2006 Ramet
2006/0150299 A1 7/2006 Geng
2007/0083980 A1 4/2007 Yang et al.
2008/0052799 A1 * 3/2008 Yoo ..... A41D 31/14 2/16
2008/0120754 A1 5/2008 Raymond
2009/0061204 A1 3/2009 Hsu et al.
2009/0077704 A1 3/2009 Duncan et al.
2009/0126074 A1 5/2009 Mattesky
2009/0139011 A1 6/2009 VanErmen et al.
2009/0158486 A1 6/2009 Cote et al.
2009/0271905 A1 11/2009 Alexander
2010/0037364 A1 2/2010 Saunders
2010/0095428 A1 4/2010 Fisher
2010/0186144 A1 7/2010 Zhu
2010/0186457 A1 7/2010 Zhu
2010/0275342 A1 * 11/2010 Sweeney ..... A41D 19/01505 2/167
2010/0325779 A1 12/2010 Matsunobu et al.
2011/0145967 A1 6/2011 Hull
2011/0287553 A1 11/2011 Hassan et al.
2011/0289652 A1 12/2011 Thompson et al.
2012/0167778 A1 7/2012 Popeil et al.
2012/0227158 A1 9/2012 Ashworth et al.
2012/0278964 A1 11/2012 Bormann-Early
2013/0152262 A1 6/2013 Bedetti et al.
2013/0180022 A1 7/2013 Baungartger
2013/0219588 A1 8/2013 Nakagawa
2013/0254964 A1 10/2013 Robinson
2013/0319055 A1 12/2013 Tatsumi et al.
2014/0137304 A1 5/2014 Katz
2014/0138968 A1 * 5/2014 Gentry ..... A47J 37/049 294/61
2014/0259255 A1 9/2014 Ragan
2015/0020284 A1 1/2015 Hull
2015/0121598 A1 5/2015 Mathews et al.
2015/0164159 A1 6/2015 Hull
2015/0313298 A1 11/2015 Bailey
2016/0029712 A1 2/2016 Hull

(56) References Cited

U.S. PATENT DOCUMENTS

| | | | | |
|---|---|---|---|---|
| 2016/0192721 | A1 | 7/2016 | Kishihara | |
| 2016/0213075 | A1* | 7/2016 | Omer | A41D 19/01505 |
| 2016/0235138 | A1 | 8/2016 | Smith | |
| 2017/0055607 | A1* | 3/2017 | Francisco Costa | A61B 42/10 |
| 2017/0215638 | A1 | 8/2017 | Markussen et al. | |
| 2018/0077980 | A1 | 3/2018 | Hull | |
| 2018/0103701 | A1 | 4/2018 | Hull | |
| 2018/0263418 | A1 | 9/2018 | Hedrington et al. | |
| 2019/0014835 | A1* | 1/2019 | Hull | A41D 13/087 |

* cited by examiner

PROTECTIVE DEVICE FOR USE WITH A GLOVE

CROSS REFERENCE TO RELATED APPLICATIONS

This application is a continuation of U.S. patent application Ser. No. 15/843,426, filed Dec. 15, 2017, which is a continuation-in-part application of U.S. patent application Ser. No. 15/384,499, filed on Dec. 20, 2016, which is a continuation-in-part application of co-pending U.S. patent application Ser. No. 14/624,047, filed on Feb. 17, 2015, which is a continuation-in-part application of U.S. patent application Ser. No. 13/947,423, filed on Jul. 22, 2013, the entirety of which is incorporated herein as if fully rewritten.

The present application is a continuation-in-part application of U.S. Ser. No. 15/185,097, filed Jun. 17, 2016, the entirety of which is incorporated herein as if fully rewritten.

BACKGROUND

Technical Field

The present invention relates generally to protective coverings. More particularly, the present invention relates to protective coverings used as a glove for a hand. Specifically, the present invention provides a protective device to cover the webbing region located between a thumb and index finger (i.e., the thumb crotch) on a liquid proof heat resistant glove or mitten.

Background Information

Humans have enjoyed roasting chickens on a rotisserie since at least the middle ages. Modern rotisserie devices are provided in the form of ovens, often at supermarkets or grocery stores. The chickens cook on a rotisserie spit that rotates in the oven. The spit is extremely sharp as it has to pierce the chicken so the chicken may be affixed to the spit while it rotates in the oven. The rotisserie oven heats up to high temperatures, often in excess of 500 degrees, and cooks the chicken.

Liquid proof heat resistant gloves are often used in commercial settings, such as delicatessens, that cook their own rotisserie chickens. These gloves are designed to protect a worker's hands from the high heat and hot liquids (e.g., grease) that are associated with the rotisserie roasting of chicken. A deli worker dons these gloves prior to removing the chickens from the spit. To remove a chicken from a spit, a worker wearing the liquid proof heat resistant gloves removes the spit from the rotating oven. The worker then grasps the spit at one end. Ordinarily, a right handed person grasps the right end of the spit with his right hand and grasps adjacent the right end of the spit with his left hand in the glove. The user then pulls the spit using his right hand in a motion similar to drawing a sword, all while continuing to grasp the spit with his left hand. As the spit travels through the user's grasped hand, the chickens are released from the spit and fall into a desired container. A problem often arises when the worker removes the chickens because drawing the spit through the grasped glove has a tendency to cut the glove surface. The liquid proof heat resistant gloves often cost around one hundred dollars a pair and currently some delicatessens are replacing cut or damaged gloves every three days.

A search for prior art revealed a protector for a ski glove. One exemplary ski glove protector is manufactured by Kombi, Ltd. of Essex Junction, Vt., USA and sold commercially under the name of "Glove Protector" available at www.skis.com. This Kombi glove protector is constructed of natural leather and is for use with ski gloves to protect a cold weather ski glove from being torn by ski tow ropes while a wearer grasps the tow rope. This Kombi glove protector is for cold weather outdoor gear and would not function in a protective manner at the high temperatures required for protecting a liquid proof heat resistant glove donned by a deli worker. The leather constructed Kombi glove would melt at the high temperature ranges in which the present invention operates.

Additionally, other protective devices used on gloves have been shown in the prior art. For example, U.S. Pat. No. 7,089,600 (the '600 patent) discloses a work glove including a fiber-made base glove with two reinforcement coats. A first reinforcement coat of compound rubber latex (essentially neoprene) extends over the crotch between the thumb and forefinger. A second reinforcement coat of compound rubber latex covers the fiber-made base glove except a back thereof includes the first reinforcement coat. Essentially, the first reinforcement coat is not covered by the second reinforcement coat on the back portion (i.e., dorsal portion or volar portion) of the glove. The first reinforcement coat and the second reinforcement coat extend along the length of the forefinger and cover the distal tip thereof. Thumb implementations of compound rubber latex may increase the stiffness of the base glove thereby reducing finger flexion or increasing finger strain and muscle strength to effectuate a similar flexion of a base glove free of the first and second reinforcement layers. Thus, while the crotch region may be covered with the first and second reinforcement layers, other drawbacks may continue to exist.

An additional attempt at protecting a portion of the hand is detailed in U.S. Pat. No. 4,873,998 (the '998 patent). The '998 patent provides a hardened plastic band formed from a thermo-plastic material that allows enough flexibility to move the hand, but also has a substantial density to protect the same. One drawback associated with the protective device of the '998 patent is that it likely could not be used in high-heat environments inasmuch as portions of the hand are exposed through the protective band.

An additional attempt at protecting the thumb-crotch region of the hand is detailed in U.S. P.G. Publication 2003/0140396 (the '396 publication). The '396 publication details a unilayer flexible textile performance fabric comprising a base fabric having at least one dissimilar high performance fiber interwoven into said base fabric. The '396 publication details that the weaving of the two distinct fibers together creates a single layer of material. The high performance fiber may be cut-resistant.

The liquid proof heat resistant gloves that are used by delicatessens (i.e., delis) that cook rotisserie chickens may sometimes be cut inadvertently when an operator is removing a cooked rotisserie chicken from a spit. This can lead to a dangerous situation inasmuch as the hot grease can penetrate the glove through the cut or tear even though the glove itself is made from a liquid proof material. The hot grease has the potential to injure the person wearing or who has donned the glove.

Furthermore, in many industries (but especially the food preparation/service industry), workers may have to handle articles that potentially can injure them. In the food services industry, for example, workers are frequently exposed to heated surfaces and hot liquids and gases that may cause severe burns. It has therefore become commonplace for workers in such environments to wear protective clothing, including temperature and fluid resistant gloves. The gloves in question need to prevent radiant heat from reaching the skin and they need to be fluid impermeable to prevent liquids and gases from penetrating into the interior of the glove, causing a contact-type injury. Similar requirements are necessary in industries where the workers are exposed to extremely cold substances, such as liquid nitrogen, or to caustic substances such as acids and bases that can severely damage flesh if they come into contact with the skin. While gloves currently known in these industries function quite well, one of the problem areas that persists is the tendency for liquids and gases to be able to penetrate the gloves when there is a failure (i.e., rip, tear, rupture, etc.). Liquids and gases tend to penetrate into the interior of the glove through these small gaps created by the failure and thereby cause injury to the wearer.

SUMMARY

Thus, while the liquid proof heat resistant gloves exist for protecting the deli worker from the hot spit and hot liquids, a need exists to protect the expensive glove from the slicing motion of the spit as it pulled through the grasped hand of the deli worker. Additionally, a need continues to exist for a liquid proof heat resistant glove to deli workers and other food service industries that can visually identify damaged glove to the wearer thereof. The present disclosure addresses these and other issues.

In one aspect, an embodiment of the present disclosure may provide a protective device for use in a high temperature and liquid environment provides a glove integrally formed with a protective member in the thumb webbing region. The protective member is not readily detectable when viewing the outside of the glove. The protective member is cut resistant and constructed to protect a worker's hand as a sharp and hot object passes over the protective member contacting the outer surface of the glove.

In another aspect, an embodiment of the present disclosure may provide a protective member for a thumb-crotch region of the glove that, prior to installing on a glove, is laid flat and the protective member comprises: a generally rounded trapezoidal-shaped edge bounding a first surface opposite a second surface; a major axis associated with the generally rounded trapezoidal-shaped edge; a minor axis associated with the generally rounded trapezoidal-shaped edge; at least two opposing slits interrupting the generally rounded trapezoidal-shaped edge, wherein the at least two slits extend parallel to the minor axis and each terminates prior to the major axis, wherein the two slits are enable the protective member to bend around a thumb region of the glove and a forefinger region of the glove such that the major axis extends over thumb-crotch region of the glove.

In another aspect, an embodiment of the present disclosure may provide a liquid proof and heat resistant protective device worn on a hand comprising: an inner liner shaped as a glove, wherein the inner liner is formed from a first material; an outer skin connected to the inner liner defining an outer surface of the glove, wherein the outer skin is formed from a second material different than the first material, and the second material is liquid proof and withstands thermal deformation and ignition at temperatures of 700 degrees Fahrenheit; a finger receiving first sleeve defined by the inner liner and outer skin connected together; a thumb receiving second sleeve defined by the inner liner and outer skin connected together; a thumb webbing region defined between the first and second sleeve; and an impermeable integral protective member intermediate and sandwiched between the inner liner and outer skin positioned in the thumb webbing region formed of a third material different than the first material of the inner liner and the second material of the outer skin, wherein the protective member is positioned entirely beneath the outer skin such that the protective member is not viewable when looking at the outer skin of the glove, wherein the impermeability of the protective member prevents the outer skin from striking therethrough when forming the outer skin by dipping the inner liner and protective member therein.

In another aspect, an embodiment of the present disclosure may provide a protective member for a thumb-crotch region of the glove that, prior to installing on a glove, is laid flat and the protective member comprises: a generally rounded trapezoidal-shaped edge bounding a first surface opposite a second surface; a major axis associated with the generally rounded trapezoidal-shaped edge; a minor axis associated with the generally rounded trapezoidal-shaped edge; at least two opposing slits interrupting the generally rounded trapezoidal-shaped edge, wherein the at least two slits extend parallel to the minor axis and each terminates prior to the major axis, wherein the two slits are enable the protective member to bend around a thumb region of the glove and a forefinger region of the glove such that the major axis extends over thumb-crotch region of the glove.

In another aspect, an embodiment of the present disclosure may provide a system for protecting an operator from a sharp object moving above a thumb-crotch region comprising: a hand from an operator including at least the following bones: a first metacarpal bone, a second carpal bone, and a third metacarpal bone; a glove donned by the hand; a protective member attached to the glove spanning the thumb-crotch region; and a first edge of the protective member crossing over the second metacarpal bone at an angle in a range from 15° to 75°. This system may further comprise a second edge of the protective member crossing over the second metacarpal bone at an angle generally orthogonal to the first edge of the protective member. The system may further comprise a third edge of the protective member generally parallel with the second edge such that the protective member is generally shaped like a trapezoid when laid flat. The system may further comprise a terminal corner of the first edge positioned approximately directly above the third metacarpal bone. The system may further provide that the protective member defines two slits to enable the protective member to bend around a thumb region of the glove and around a forefinger region of the glove such that the major axis extends over the thumb-crotch region defined between the thumb region and the forefinger region.

In accordance with one aspect of the present disclosure, an embodiment may provide a glove comprising: an index finger sleeve including a base and a closed tip and a first longitudinal axis extending through the base and closed tip; a thumb sleeve including a base end closed tip and a second longitudinal axis extending through the base and closed tip of the thumb sleeve; a vertex defined at an intersection of the first longitudinal axis and the second longitudinal axis; an outer skin defining a continuous outer surface of the glove extending from a palmar side to an opposite dorsal side of the glove; an inner liner defining a continuous inner surface extending from the palmar side of the glove to the dorsal side of the glove, wherein the continuous inner surface defines interior cavity adapted to receive a hand of the wearer therein; a thumb crotch region of the glove defined between the base of the index finger sleeve and the base of the thumb sleeve, and defined between the first longitudinal axis and the second longitudinal axis on both sides (the palmar side and the dorsal side) of the glove, wherein the thumb crotch region further is defined as extending over and around from the palmar side of the glove to the dorsal side of the glove between the index finger sleeve and the thumb sleeve; a protective member disposed in the thumb crotch region, and in one embodiment not outside the thumb crotch region, that is sandwiched, or layer, or positioned between the outer skin and the inner liner; wherein the outer skin is a first color, the protective member is a second color, and the inner liner is a third color. In one particular embodiment, at least one of the first, second, and third colors is different from the other remaining colors. In another particular embodiment, all three of the first, second, and third colors are different.

In accordance with one aspect, an embodiment of the present disclosure may provide a liquid proof and heat resistant glove comprising: an outer skin defining an outer surface, wherein the outer skin is formed from a material that withstands thermal deformation at a temperature of at least 700° F.; an inner liner defining an inner surface defining a hand shaped cavity adapted to receive a hand of a user; a protective member disposed between the outer skin and the inner liner, wherein the protective member is formed from a material that is more impenetrable and different than the outer skin and the inner liner, and the protective member is a different lighter color than the outer skin which is adapted to visually alert the user in the event of a rupture in the outer skin.

In accordance with one aspect, an embodiment of the present disclosure may provide a method comprising: donning a liquid proof heat resistant glove having a protective member located in a thumb crotch region between an outer skin and an inner liner; drawing an elongated member over the thumb crotch region; determining whether the outer skin is damaged; and disposing the glove if the outer skin is damaged.

In yet another aspect, an embodiment of the present disclosure may provide a method comprising: providing a liquid proof and heat resistant glove including a protective member positioned between an outer skin and an inner liner, wherein the protective member is a different color than the outer skin; effecting the protective member to be visually identified in the event of rupturing the outer skin; and effecting the disposal of the glove based on the rupturing of the outer skin identified by the different color of the protective member.

In yet another aspect, an embodiment of the present disclosure may provide a glove comprising: an outer layer defining an outer surface shaped in the form of one of a glove and a mitten; an inner liner defining an inner liner adapted to receive a hand therein; wherein the outer skin is connected to the inner liner; a thumb sleeve including a base and a closed tip, and a first longitudinal axis extending through the base and closed tip of the thumb sleeve; an index finger sleeve including a base and a closed tip, and a second longitudinal axis extending through the base and closed tip of the index finger sleeve; a vertex located at the intersection of the first longitudinal axis and the second longitudinal axis; a palmar side of the glove opposite a dorsal side of the glove; a thumb crotch region defined between the first longitudinal axis and the second longitudinal axis and the thumb crotch region extending around from the palmar side to the dorsal side between the index finger sleeve and the thumb sleeve; a protective member in the thumb crotch region disposed between the outer skin and the inner liner, the protection member having a different color than the outer skin, the different color adapted to visually alert a rupture of the outer skin in the thumb crotch region.

In yet another aspect, an embodiment of the present disclosure may provide a glove comprising: an outer skin defining an outer surface; an inner liner defining an inner liner adapted to receive a hand therein; wherein the outer skin is connected to the inner liner; a thumb sleeve including a base and a closed tip, and a first longitudinal axis extending through the base and closed tip of the thumb sleeve; an index finger sleeve including a base and a closed tip, and a second longitudinal axis extending through the base and closed tip of the index finger sleeve; a vertex located at the intersection of the first longitudinal axis and the second longitudinal axis; a palmar side of the glove opposite a dorsal side of the glove; a thumb crotch region defined between the first longitudinal axis and the second longitudinal axis and the thumb crotch region extending around from the palmar side to the dorsal side between the index finger sleeve and the thumb sleeve; and a protective member located in the thumb crotch region disposed between the outer skin and the inner liner, wherein the protective member is a different color than the outer skin, and the different color adapted to visually alert a glove failure occurrence in the outer skin in the thumb crotch region. This embodiment or another embodiment may further provide wherein the outer surface is a first color; wherein the protective member is a lighter and brighter second color adapted to visually identify a glove failure against a darker backdrop created by the first color. This embodiment or another embodiment may further provide wherein the outer skin is formed from a material that absorbs more light than the protective member; and wherein the protective member is formed from a material that reflects more light than the outer surface so as to visually identify the glove failure against a darker backdrop created by the first color. This embodiment or another embodiment may further provide a color splash effect that is established when the glove fails adapted to visually identify the glove failure against a darker backdrop created by the outer surface.

In yet another aspect, an embodiment of the present disclosure may provide a liquid proof and heat resistant glove comprising: an outer layer defining an outer surface shaped in the form of one of a glove and a mitten, wherein the outer skin is formed from a material that is liquid impermeable and withstands thermal deformation at a temperature of at least 300° F.; and a protective member disposed below the outer skin, wherein the protective member is formed from a material that is different than the outer skin, and the protective member is a different lighter color than the outer skin which is adapted to visually alert the user in the event of a rupture in the outer skin. This embodiment or another embodiment may further provide an inner liner defining an inner surface defining a hand shaped cavity adapted to receive a hand of a user; and wherein the protective member is disposed above the inner liner so as to be positioned between the outer skin and the inner liner. This embodiment or another embodiment may further provide a thumb crotch region defined between an index finger sleeve and a thumb sleeve, and the thumb crotch region extending around the glove from a palmar side to a dorsal side; wherein the protective member is located in the thumb crotch region. This embodiment or another embodiment may further provide a major surface area of the protective member, wherein the major surface occupies a majority of the thumb crotch region. This embodiment or another embodiment may further provide wherein the major surface entirely occupies the thumb crotch region and extends beyond the thumb crotch region. This embodiment or another embodiment may further provide wherein the material forming the protective member is more rigid than the outer skin and more resistant to failure than the outer skin when a sharpened edge is contacted and moved along the protective member.

In yet another aspect, an embodiment of the present disclosure may provide a method comprising: providing a liquid proof and heat resistant glove including a protective member positioned beneath an outer skin, wherein the protective member is a different color than the outer skin; effecting the protective member to be visually identified in response to rupturing the outer skin; and effecting the disposal of the glove based on the rupturing of the outer skin identified by the different color of the protective member. This embodiment or another embodiment may further provide wherein effecting the protective member to be visually identified in response to rupturing the outer skin is accomplished by establishing a color splash effect against a darker backdrop created by the outer skin. This embodiment or another embodiment may further provide wherein effecting the protective member to be visually identified in response to rupturing the outer skin is accomplished by establishing the different color of the protective member is lighter and brighter than the outer skin. This embodiment or another embodiment may further provide wherein rupturing the outer skin occurs in response to drawing a spit over the outer skin in a thumb crotch region. This embodiment or another embodiment may further provide wherein effecting the protective member to be visually identified in response to rupturing of the outer layer is accomplished by establishing a first color of the outer layer is the darkest color of any portion of the liquid proof and heat resistant glove. This embodiment or another embodiment may further provide wherein effecting the protective member to be visually identified in response to rupturing of the outer layer is accomplished by establishing different color parameters between the first color and the second color. This embodiment or another embodiment may further provide wherein effecting the protective member to be visually identified in response to rupturing of the outer layer is accomplished by establishing a lightness of the protective member is more than a lightness of the outer layer. This embodiment or another embodiment may further provide wherein effecting the protective member to be visually identified in response to rupturing of the outer layer is accomplished by establishing a chrominance of the second color is farther away from dark chrominance than the first color. This embodiment or another embodiment may further provide wherein effecting the protective member to be visually identified in response to rupturing of the outer layer is accomplished by establishing a hue associated with the protective member that is darker than a hue associated with the outer layer. This embodiment or another embodiment may further provide wherein effecting the protective member to be visually identified in response to rupturing of the outer layer is accomplished by establishing reflective properties of the protective member.

In another aspect, an embodiment of the present disclosure may provide a method comprising: donning a liquid proof heat resistant glove having a protective member located in a thumb crotch region beneath an outer skin; drawing an elongated member over the thumb crotch region; determining whether the outer skin is damaged; and disposing the glove in response to determining that the outer skin is damaged. This embodiment or another embodiment may further provide wherein determining whether the outer skin is damaged is accomplished by viewing the protective member through a break or rupture in the outer skin. This embodiment or another embodiment may further provide wherein the protective member is a different color than the outer skin. This embodiment or another embodiment may further provide wherein the protective member is lighter in color than the outer skin so as to allow the protective member to be readily identifiable in the event of rupture. This embodiment or another embodiment may further provide wherein the protective member is brighter in color than the outer skin so as to allow the protective member to be readily identifiable in the event of rupture. This embodiment or another embodiment may further provide wherein the protective member is unable to be viewed when the outer skin of the glove is whole and uncut or unadulterated or intact. This embodiment or another embodiment may further provide submerging the thumb crotch region of the glove into a hot liquid contained by a cooking device in response to the determination that the glove is not damaged. This embodiment or another embodiment may further provide submerging the thumb crotch region of the glove into heated frying oil contained by a deep fryer. This embodiment or another embodiment may further provide wherein drawing the elongated member over the thumb crotch region is accomplished by a rotisserie spit moving over the outer layer of the glove. This embodiment or another embodiment may further provide removing poultry from the rotisserie spit while grasping the rotisserie spit with one hand and pulling the rotisserie spit with another hand. This embodiment or another embodiment may further provide wherein the step of removing poultry from the rotisserie spit while grasping the rotisserie spit with one hand and pulling the rotisserie spit with another hand occurs prior to the step of submerging the thumb crotch region of the glove into heated frying oil contained by a deep fryer.

In yet another aspect, an embodiment of the present disclosure may provide a glove comprising: an outer layer defining an outer surface; an inner liner defining an inner liner adapted to receive a hand therein; wherein the outer layer is connected to the inner liner; a thumb sleeve including a base and a closed tip, and a first longitudinal axis extending through the base and closed tip of the thumb sleeve; an index finger sleeve including a base and a closed tip, and a second longitudinal axis extending through the base and closed tip of the index finger sleeve; a vertex located at the intersection of the first longitudinal axis and the second longitudinal axis; a palmar side of the glove opposite a dorsal side of the glove; a thumb crotch region defined between the first longitudinal axis and the second longitudinal axis and the thumb crotch region extending around from the palmar side to the dorsal side between the index finger sleeve and the thumb sleeve; and a protective member located in the thumb crotch region disposed between the outer skin and the inner liner, wherein the protective member is a different color than the outer skin, and the different color adapted to visually alert a glove failure occurrence in the outer skin in the thumb crotch region.

In yet another aspect, an embodiment of the present disclosure may provide a color splash effect that is established by a darker backdrop color of an outer surface of a liquid proof and heat resistant glove in the event that a portion of the glove ruptures or fails. The color splash effect is accomplished by a lighter and brighter color being visible through the rupture in the glove. The lighter and brighter color may be formed on or as part of a protective member positioned beneath the outer layer. The protective member also protects the wearer against sharp objects contacting the outer layer of the glove and moving over the protective member. Some embodiments provide that the protective member is in a thumb crotch region of the glove.

In yet another aspect, an embodiment of the present disclosure may provide a glove comprising: an outer layer defining an outer surface; an inner liner defining an inner liner adapted to receive a hand therein; wherein the outer layer is connected to the inner liner; a thumb sleeve including a base and a closed tip, and a first longitudinal axis extending through the base and closed tip of the thumb sleeve; an index finger sleeve including a base and a closed tip, and a second longitudinal axis extending through the base and closed tip of the index finger sleeve; a vertex located at the intersection of the first longitudinal axis and the second longitudinal axis; a palmar side of the glove opposite a dorsal side of the glove; a thumb crotch region defined between the first longitudinal axis and the second longitudinal axis and the thumb crotch region extending around from the palmar side to the dorsal side between the index finger sleeve and the thumb sleeve; and a protective member located in the thumb crotch region disposed between the outer skin and the inner liner. This embodiment or another may further provide wherein the protective member is a different color than the outer skin, and the different color adapted to visually alert a glove failure occurrence in the outer skin in the thumb crotch region. This embodiment or another may further provide wherein the outer surface is a first color; wherein the protective member is a lighter and brighter second color adapted to visually identify a glove failure against a darker backdrop created by the first color. This embodiment or another may further provide wherein the outer layer is formed from a material that absorbs more light than the protective member; and wherein the protective member is formed from a material that reflects more light than the outer surface so as to visually identify a glove failure against a darker backdrop created by the outer layer. This embodiment or another may further provide a color splash effect that is established when the glove fails to visually identify the glove failure against a darker backdrop created by the outer surface.

In yet another aspect, an embodiment of the present disclosure may provide a liquid proof and heat resistant glove comprising: an outer layer defining an outer surface shaped in the form of one of a glove and a mitten, wherein the outer layer is formed from a material that is liquid impermeable and withstands thermal deformation at a temperature of at least 300° F.; and a colored layer positioned beneath the outer layer that establishes a visually identifiable color splash effect in the event the outer layer ruptures to effectuate an alert that the liquid proof and heat resistant glove is damaged and should be disposed. This embodiment or another embodiment may further provide a first color associated with the outer layer and a second color associated with colored layer beneath the outer layer that is only visual through a rupture in the outer layer. This embodiment or another embodiment may further provide wherein the first color is the darkest color of any portion of the liquid proof and heat resistant glove. This embodiment or another embodiment may further provide different color parameters between the first color and the second color. This embodiment or another embodiment may further provide a lightness of the second color is more than a lightness of the first color. This embodiment or another embodiment may further provide a chrominance of the second color is farther away from dark chrominance than the first color. This embodiment or another embodiment may further provide a hue of the first color is darker than a hue of the second color. This embodiment or another embodiment may further provide wherein the second color is less saturated when viewed from the outside through a rupture so as to exhibit a higher brightness and colorfulness than the first color. This embodiment or another embodiment may further provide wherein the second color is reflective.

In yet another aspect, an embodiment of the present disclosure may provide a dual purpose glove that is liquid proof and temperature resistant, the dual purpose glove comprising: a liquid proof and heat resistant outer layer; an inner liner; a colored layer disposed intermediate the outer layer and the inner liner that establishes a visually identifiable color splash effect in the event the outer layer ruptures to effectuate an alert that the dual purpose glove is damaged and should neither be donned during removal of poultry from a rotisserie spit nor donned during submersion into hot liquid. This embodiment or another embodiment may further provide, in combination with a rotisserie spit and a cooking device containing hot fluid, the combination further comprising: a first mode of the glove for removal of poultry from the rotisserie spit; and a second mode of the glove for submersion into the hot fluid; wherein are the first mode and the second mode are terminated in the event that the glove is damaged as alerted by the colored layer through the rupture. This combination embodiment or another embodiment may further provide a first color associated with the outer layer and a second color associated with color layer beneath the outer layer that is only visual through a rupture in the outer layer. This combination embodiment or another embodiment may further provide wherein the dual purpose glove further includes wherein the first color is the darkest color of any portion of the dual purpose glove. This combination embodiment or another embodiment may further provide wherein the dual purpose glove further includes different color parameters between the first color and the second color. This combination embodiment or another embodiment may further provide wherein a lightness of the second color is more than a lightness of the first color. This combination embodiment or another embodiment may further provide wherein a chrominance of the second color is farther away from dark chrominance than the first color. This combination embodiment or another embodiment may further provide wherein a hue associated with the first color is darker than a hue associated with the second color. This combination embodiment or another embodiment may further provide wherein the second color is less saturated when viewed from the outside through the rupture so as to exhibit a higher brightness and colorfulness in the light than the first color. This combination embodiment or another embodiment may further provide wherein the second color is reflective.

In yet another aspect, an embodiment of the present disclosure may provide a system comprising: a dual purpose glove that is liquid proof and temperature resistant including a colored layer disposed intermediate an outer layer and an inner liner that establishes a visually identifiable color splash effect in the event the outer layer ruptures to effectuate an alert that the dual purpose glove is damaged; a cooking device containing a hot liquid, wherein the dual purpose glove is sized and formed for safe submersion into the hot liquid; and a rotisserie spit, wherein the dual purpose glove is shaped and formed for safe movement of the rotisserie spit above the outer layer. This system embodiment or another system embodiment may further provide wherein the dual purpose glove includes: a first color associated with the outer layer and a second color associated with a portion of the glove beneath the outer layer that is only visual through a rupture in the outer layer. This system embodiment or another system embodiment may further provide wherein the dual purpose glove further includes wherein the first color is the darkest color of any portion of the dual purpose glove. This system embodiment or another system embodiment may further provide wherein the dual purpose glove further includes different color parameters between the first color and the second color. This system embodiment or another system embodiment may further provide wherein a lightness of the second color is more than a lightness of the first color. This system embodiment or another system embodiment may further provide wherein a chrominance of the second color is farther away from dark chrominance than the first color. This system embodiment or another system embodiment may further provide wherein a hue associated with the first color is darker than a hue associated with the second color. This system embodiment or another system embodiment may further provide wherein the second color is less saturated when viewed from the outside through the rupture so as to exhibit a higher brightness and colorfulness in the light than the first color. This system embodiment or another system embodiment may further provide wherein the second color is reflective.

In yet another aspect, an embodiment of the present disclosure may provide a temperature resistant and fluid impermeable protective glove having front and back panels joined together. The panels may be joined together, in one embodiment, by at least one seam. Or, the panels may be integrally formed together during fabrication. During fabrication/manufacture, the glove is dipped into a first thin liquid to coat the exterior surface of the glove. The first liquid penetrates through gaps in seams and other locations, such as on a drilled cotton liner, and seals gaps as it solidifies. The first liquid coated glove is then dipped into a second thicker liquid to coat the entire exterior surface including a protective member in the thumb crotch region. A third coating may be applied to the interior surface of the glove prior to joining the front and back panels together. Preferably, the third coating is a blade-coating that improves the gloves cut and penetration strength and thermal resistance.

In accordance with yet another aspect, an embodiment of the present disclosure may provide a dual purpose glove that is liquid proof and temperature resistant, the dual purpose glove comprising: a liquid proof and heat resistant outer layer; an inner liner; one of a colored layer and a colored member disposed intermediate the outer layer and the inner liner that establishes a visually identifiable color splash effect in the event the outer layer ruptures to effectuate an alert that the dual purpose glove is damaged and should neither be donned during removal of poultry from a rotisserie spit nor donned during submersion into hot liquid. This embodiment or another embodiment may further provide in combination with a rotisserie spit and a cooking device containing hot fluid, the combination further comprising: a first mode of the glove for removal of poultry from the rotisserie spit; and a second mode of the glove for submersion into the hot fluid; wherein the first mode and the second mode are terminated in the event that the glove is damaged as alerted by the colored layer through a rupture in the outer layer. This embodiment or another embodiment may further provide a first color associated with the outer layer and a second color associated with the one of a colored layer and a colored member beneath the outer layer that is only visual through the rupture in the outer layer. This embodiment or another embodiment may further provide wherein the first color is the darkest color of any portion of the dual purpose glove. This embodiment or another embodiment may further provide wherein the dual purpose glove further includes different color parameters between the first color and the second color. This embodiment or another embodiment may further provide wherein a lightness of the second color is more than a lightness of the first color. This embodiment or another embodiment may further provide wherein a chrominance of the second color is farther away from dark chrominance than the first color. This embodiment or another embodiment may further provide wherein a hue associated with the first color is darker than a hue associated with the second color. This embodiment or another embodiment may further provide wherein the second color is less saturated when viewed from the outside through the rupture so as to exhibit a higher brightness and colorfulness in the light than the first color. This embodiment or another embodiment may further provide wherein the second color is reflective.

In yet another aspect of the present disclosure, an embodiment may provide a system comprising: a dual purpose glove that is liquid proof and temperature resistant including one of a colored layer and a colored member disposed beneath an outer layer that establishes a visually identifiable color splash effect in the event the outer layer ruptures to effectuate an alert that the dual purpose glove is damaged; a cooking device containing a hot liquid, wherein the dual purpose glove is sized and formed for safe submersion into the hot liquid; and a rotisserie spit, wherein the dual purpose glove is shaped and formed for safe movement of the rotisserie spit above the outer layer. This embodiment or another embodiment may further provide a first color associated with the outer layer and a second color associated with a portion of the one of a colored layer and a colored member beneath the outer layer that is only visual through a rupture in the outer layer. In this embodiment, or another, a cooking device is a deep fryer and the hot liquid is frying oil heated to a temperature of at least 325° F.

In yet another aspect of the present disclosure, an embodiment may provide a dual purpose glove that is liquid proof and temperature resistant, the dual purpose glove comprising: a liquid proof and heat resistant outer layer; one of a colored layer and a colored member disposed below the outer layer that establishes a visually identifiable color splash effect in the event the outer layer ruptures to effectuate an alert that the dual purpose glove is damaged and should neither be donned during removal of poultry from a rotisserie spit nor donned during submersion into hot liquid.

In yet another aspect, an embodiment of the present disclosure may provide a method comprising: donning a liquid proof and temperature resistant glove; performing a first operation, wherein the first operation is one of drawing an elongated member over an outer layer of the glove and submerging the glove into hot liquid; and performing a second operation, wherein the second operation is the other of drawing the elongated member over the outer layer of the glove and submerging the glove into hot liquid. This embodiment or another embodiment may further include determining whether the outer layer is damaged; and disposing the glove in response to determining that the outer layer is damaged. This embodiment or another embodiment may further include wherein determining whether the outer layer is damaged is accomplished by viewing the protective member through a break or rupture in the outer layer. This embodiment or another embodiment may further include wherein a portion of the glove below the break or rupture is a different color than the outer layer so as to effectuate a color splash effect against the outer layer of the glove. This embodiment or another embodiment may further include identifying, visually, one of a colored layer and a colored member in response to rupturing of the outer layer; and disposing the glove based on the rupturing of the outer layer identified by the one of a colored layer and a colored member.

In yet another aspect, an embodiment of the present disclosure may provide a dual purpose glove that is liquid proof and temperature resistant, the dual purpose glove comprising: a liquid proof and temperature resistant outer layer, wherein the outer layer is formed from a material that is liquid impermeable and withstands thermal deformation at a temperature of at least 300° F. and is protectively insulative to a temperature of at least at least 300° F. for a period of at least one second adapted to protect a wearer when the dual purpose glove is donned and submerged into hot liquid and to protect the wearer when the dual purpose glove is donned and grasps a sharpened elongated member.

In yet another aspect, an embodiment of the present disclosure may provide a method comprising: donning a liquid proof and heat resistant glove having a protective member located in a thumb crotch region beneath an outer layer; drawing an elongated member over the thumb crotch region; determining whether the outer layer is damaged; determining whether a protective member positioned beneath the outer layer is damaged; and disposing the glove in response to determining that the protective member is damaged. This method or another exemplary method may further include wherein determining whether the protective member is damaged is accomplished by viewing a colored layer through a break or rupture in the protective member. This method or another exemplary method may further include wherein a portion of the colored layer is a different color than the protective member. This method or another exemplary method may further include wherein the colored layer is lighter and brighter in color than the protective member so as to allow the colored layer to be readily identifiable in the event of rupture. This method or another exemplary method may further include wherein the colored layer is unable to be viewed when the protective member of the glove is whole, uncut, unadulterated, and intact. This method or another exemplary method may further include submerging the thumb crotch region of the glove into a hot liquid contained by a cooking device in response to the determination that the protective member is not damaged regardless of whether the outer layer is damaged. This method or another exemplary method may further include submerging the thumb crotch region of the glove into heated liquid frying oil contained by a deep fryer. This method or another exemplary method may further include wherein drawing the elongated member over the thumb crotch region is accomplished by a rotisserie spit moving over the outer layer of the glove. This method or another exemplary method may further include removing poultry from the rotisserie spit while grasping the rotisserie spit with one hand and pulling the rotisserie spit with another hand. This method or another exemplary method may further include wherein the step of removing poultry from the rotisserie spit while grasping the rotisserie spit with one hand and pulling the rotisserie spit with another hand occurs prior to submerging the thumb crotch region of the glove into heated frying oil contained by a deep fryer.

In another aspect, an exemplary embodiment of the present disclosure may provide a method comprising: donning a liquid proof and temperature resistant glove; performing a first operation, wherein the first operation is one of drawing an elongated member over an outer layer of the glove or submerging the glove into hot liquid; and performing a second operation, wherein the second operation is the other of drawing the elongated member over the outer layer of the glove or submerging the glove into hot liquid. This method or another exemplary method may further include determining whether there is a rupture in a portion of the liquid proof and temperature resistant glove; and disposing the glove in response to determining that the rupture. This method or another exemplary method may further include wherein determining whether there is a rupture is accomplished by viewing one of a colored layer or a colored member through the rupture. This method or another exemplary method may further include wherein a portion of the glove below the rupture is a different color than the outer layer so as to effectuate a color splash effect against the outer layer of the glove. This method or another exemplary method may further include wherein the rupture is in a protective member positioned below the outer layer and the colored layer or colored member is positioned below the protective member. This method or another exemplary method may further include identifying, visually, one of a colored layer and a colored member in response to a rupture; and disposing the glove based on the rupture identified by the one of a colored layer and a colored member.

In yet another aspect, an embodiment of the present disclosure may provide a dual purpose glove that is liquid proof and temperature resistant, the dual purpose glove comprising: a liquid proof and temperature resistant outer layer, wherein the outer layer is formed from a material that is liquid impermeable and withstands thermal deformation at a temperature of at least 700° F. and is protectively insulative to a temperature of at least at least 700° F. for a period of at least one second adapted to protect a wearer when the dual purpose glove is donned and submerged into hot liquid and to protect the wearer when the dual purpose glove is donned and grasps a sharpened elongated member. This embodiment or another embodiment may further include one of a colored layer and a colored member disposed below the outer layer that establishes a visually identifiable color splash effect in the event the outer layer ruptures to effectuate an alert that the dual purpose glove is damaged and should neither be donned during removal of poultry from a rotisserie spit nor donned during submersion into hot liquid. This embodiment or another embodiment may further include a rotisserie spit and a cooking device containing hot fluid, the combination further comprising: a first mode of the glove for removal of poultry from the rotisserie spit; and a second mode of the glove for submersion into the hot fluid; wherein the first mode and the second mode are terminated in the event that the glove is damaged as alerted by the colored layer visible through a rupture. This embodiment or another embodiment may further include a first color associated with the outer layer and a second color associated with the one of a colored layer and a colored member beneath the outer layer that is only visual through the rupture. This embodiment or another embodiment may further include wherein the dual purpose glove further includes wherein the first color is the darkest color of any portion of the dual purpose glove. This embodiment or another embodiment may further include wherein the dual purpose glove further includes different color parameters between the first color and the second color. This embodiment or another embodiment may further include wherein a lightness of the second color is more than a lightness of the first color and is farther away from dark chrominance than the first color. This embodiment or another embodiment may further include wherein a hue associated with the first color is darker than a hue associated with the second color. This embodiment or another embodiment may further include wherein the second color is less saturated when viewed from the outside through the rupture so as to exhibit a higher brightness and colorfulness in the light than the first color. This embodiment or another embodiment may further include wherein the second color is reflective.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Initially, it is noted that the present disclosure is a continuation-in-part application of U.S. patent application Ser. No. 15/384,499, (the '499 Disclosure) filed on Dec. 20, 2016, the entirety of which is incorporated herein as if fully rewritten. Additionally, it is noted that the present disclosure is also a continuation-in-part application of U.S. Ser. No. 15/185,097 (the '097 Disclosure), filed Jun. 17, 2016, the entirety of which is incorporated herein as if fully rewritten. The present disclosure touches upon additional subject matter to the aforementioned '499 Disclosure and the '097 Disclosure, namely, liquid proof heat resistant gloves that include integrally formed protective members in, on, along, or extending over the thumb crotch or thumb webbing region or other locations of the glove that are constructed to easily identify glove failure through differing colors. Since this is a continuation-in-part application of the '499 Disclosure and the '097 Disclosure, some similar structural nomenclature is used herein when referencing some portions of the glove. However, there may be some instances where structural nomenclature differs between similar elements and there may be other instances where nomenclature is similar between distinct elements relative to this application and the '499 Disclosure and the '097 Disclosure.

A protective member for protecting the thumb crotch region of a liquid proof and heat resistant glove is shown generally throughout FIG. 1 through FIG. 7B at 10. Protective member 10 may include a first portion 12, a second portion 14, and a third portion 16. As will be described in greater detail below, first portion 12, second portion 14, and third portion 16 are connected together to define a unique shape of protective member 10 to cover the thumb crotch region of a liquid proof and heat resistant glove. However, it is to be understood that protective member 10 may be formed as a unibody monolithic member and the regions described herein are to be understood as descriptive of locations relative to other portions of the protective device and are not necessarily independent structures.

Figure 1:
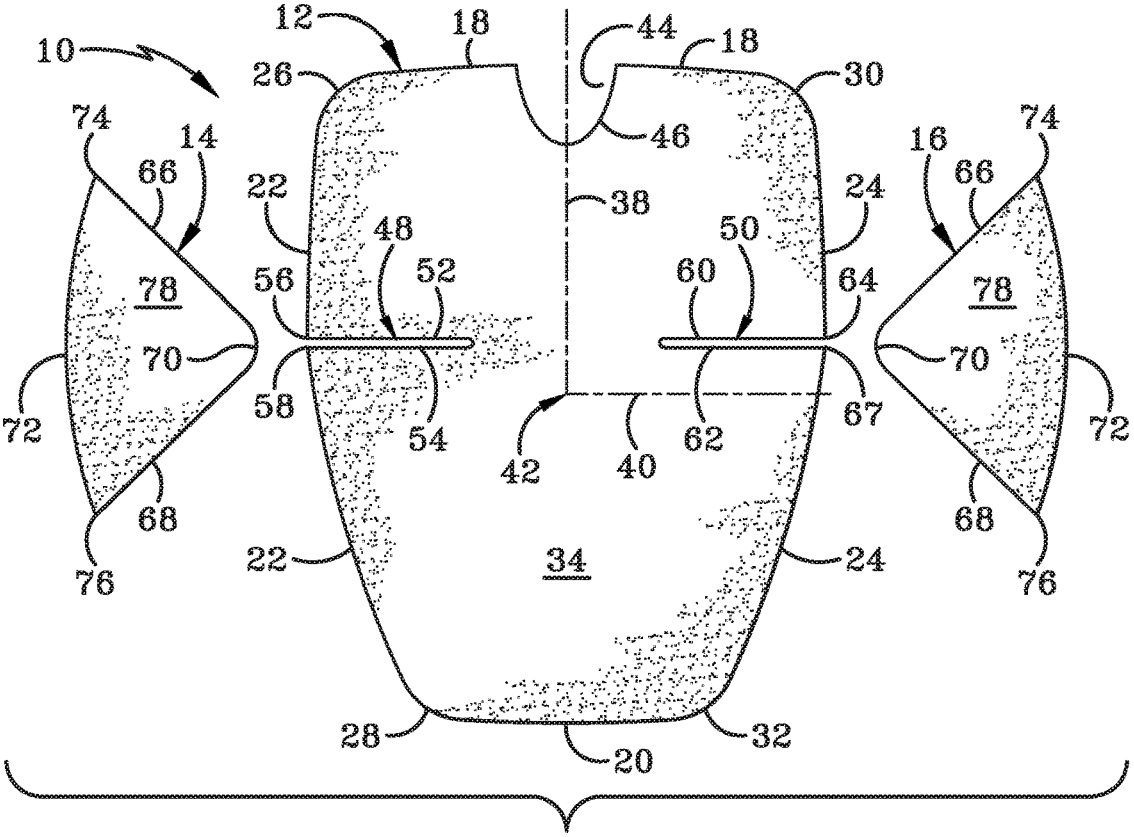
FIG. 1 is an exploded top view of components that define a protective member for use with a liquid proof and heat resistant glove.

FIG. 1 depicts an exploded top view of the first portion 12, the second portion 14, and the third portion 16 laid flat and separated from each other. When laid flat, the first portion 12 is generally trapezoidal in shape having rounded corners. In this embodiment, the first portion 12 may include a first edge 18 spaced apart and generally parallel to a second edge 20. First portion 12 may further include a third edge 22 extending between first edge 18 and second edge 20. First portion 12 may further include a fourth edge 24 that is opposite and spaced apart from third edge 22 and extends between first edge 18 and second edge 20. The third edge 22 meets the first edge 18 at a rounded first corner 26. Additionally, third edge 22 meets the second edge 20 at a rounded second corner 28. The fourth edge 24 meets the first edge 18 at a rounded third corner 30. Additionally, the fourth edge 24 meets the second edge 20 at a rounded fourth corner 32. The aforementioned edges and corners bound an upwardly facing top surface 34 and a downwardly facing bottom surface 36. Surface 34 and surface 36 are the largest surfaces of the protective member 10 and thus establish a major surface area. The major surface area occupies all or at least a majority of the thumb crotch region.

FIG. 1 further depicts an imaginary longitudinal axis 38 (i.e., the major axis) perpendicularly intersecting an imaginary transverse axis 40 (i.e., the minor axis). The center 42 of first portion 12 is located where the longitudinal axis 38 intersects the transverse axis 40.

The first portion 12 defines an arcuate cutout region 44 by an arcuately concave edge 46 interrupting first edge 18. In one particular embodiment, the arcuately extending concave edge 46 intersects the imaginary longitudinal axis 38. However, in other embodiments, edge 46 may be located at other portions of first edge 18 to define a cutout region 44. Moreover, in another embodiment, the base, or lowermost portion of concave edge 46, which is closest to transverse axis 40, may intersect longitudinal axis 38.

First portion 12 may further define a first slit 48 and a second slit 50. The first slit 48 extends towards the longitudinal axis 38 from the third edge 22. The first slit 48 interrupts third edge 22 and is arranged generally parallel with transverse axis 40 when the first portion 12 is laid flat. In one embodiment, first slit 48 may be offset from transverse axis 40. In yet another embodiment, the first slit 48 is offset towards the first edge 18 relative to transverse axis 40. The second slit 50 extends towards the longitudinal axis 38 from the fourth edge 24 and interrupts the same. The second slit 50 is offset generally parallel to the transverse axis 40 and in one embodiment, the first slit 48 and the second slit 50 are coplanar and offset towards the first edge 18 from the transverse axis 40. In some implementations, the first portion 12 may be entirely continuous and uninterrupted for all regions of the first portion 12 offset towards the second edge 20 from the transverse axis 40.

The length of the first slit 48 and the second slit 50 is oriented generally parallel with the transverse axis 40. In one implementation, the length of the first slit 48 is equal to the length of the second slit 50. In this case, the length of the first slit 48 and the second slit 50 may be in a range from about 0.5 inches to about three inches. Moreover, in other implementations, the length of the first slit 48 is close to about 1.5 inches.

The first slit 48 is bound by a first slit first edge 52 and a first slit second edge 54. The first slit first and second edges 52, 54 are spaced apart and extend generally parallel to each other and are oriented generally parallel to the transverse axis 40 when protective member 10 is laid fat. First edge 52 meets edge 22 at a corner 56 that is positioned outwardly relative to the inner terminal end of first slit 48. Similarly, second edge 54 meets edge 22 outwardly from the terminal end of first slit 48 relative to the longitudinal axis 38 at a corner 58.

Second slit 50 is bound by a second slit first edge 60 and second slit second edge 62. The second slit first and second edges 60, 62 extend generally parallel and offset from each other and are also parallel to transverse axis 40. First edge 60 extends transversely from a corner 64 towards the inner terminal end of second slit 50. Corner 64 is located where first edge 60 meets fourth edge 24 of the first portion 12. Second edge 62 extends transversely from a corner 67 inwardly towards an inner terminal end of second slit 50. Corner 67 is located where second edge 62 meets edge 24 of the first portion 12.

Reference is now made to the second portion 14 and the third portion 16 inasmuch as they are similarly shaped. Similar reference numerals are utilized for brevity. Each of the second portion 14 and third portion 16 are shaped generally similar to that of an isosceles triangle when laid flat. A first edge 66 is formed generally at a right angle to edge 68 defining a rounded corner 70. An arcuate edge 72 represents a hypotenuse between edge 66 and edge 68 relative to the rounded corner 70. Edge 66 and edge 68 are generally the same length. The arcuate edge 72 meets edge 66 at a corner 74. The arcuate edge 72 meets edge 68 at corner 76. The collective edges of second portion 14 and third portion 16 bound a first surface 78 which faces an opposite second surface 80. First surface 78 of second portion 14 and third portion 16 faces the same direction as top surface 34 of first portion 12. Second surface 80 of second portion 14 and third portion 16 faces the same direction as the bottom surface 36 of first portion 12. Generally, the second portion 14 may be considered as a first quarter-round shaped member having an arcuate edge, and two perpendicular edges meeting at a point, wherein the first quarter-round shaped member is adapted to be disposed within one slit formed by the first portion 12. Similarly, the third portion 16 may be considered a second quarter-round shaped member having an arcuate edge, and two perpendicular edges meeting at a point, wherein the second quarter-round shaped member is adapted to be disposed within an opposing slit on the first portion 12.

Figure 2:
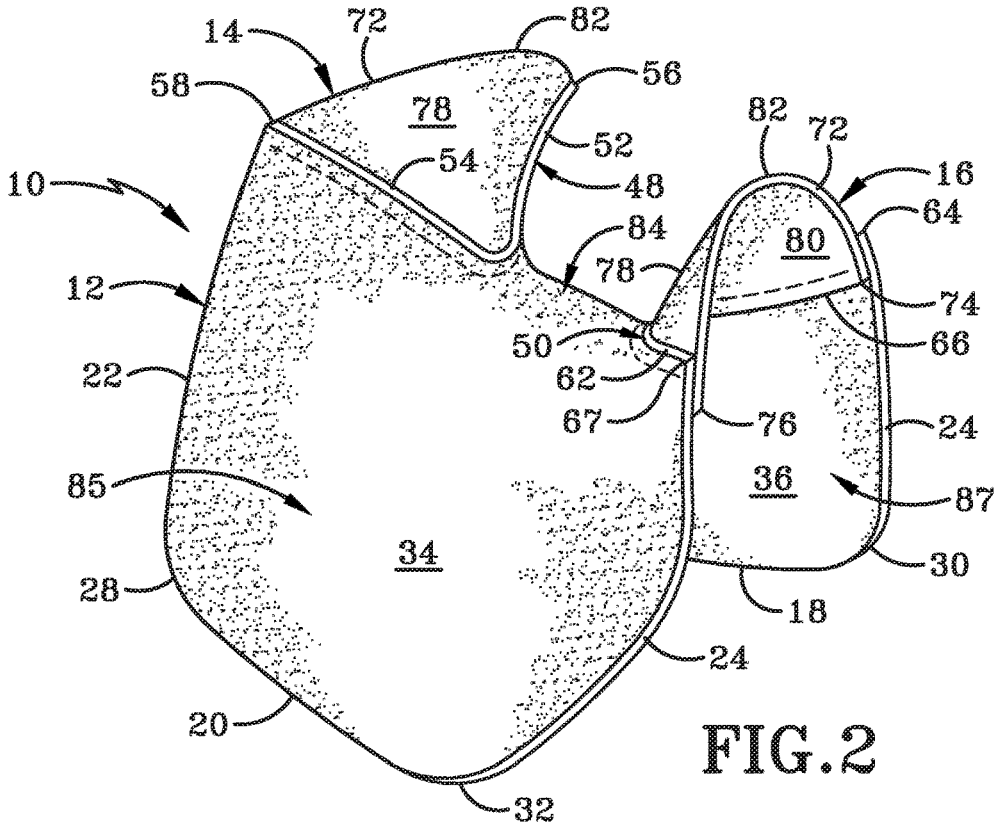
FIG. 2 is an assembled perspective view of the protective member.

FIG. 2 depicts an assembled perspective view of the protective member 10. When assembled, the second portion 14 occupies the space between first slit first edge 52 and first slit second edge 54. The second portion 14 is oriented such that the rounded corner 70 is positioned closely adjacent the inner terminal end of first slit 48. The corners 56, 58 are spread from each other such that corner 56 is aligned proximate corner 74 on second portion 14. Corner 58 is aligned proximate corner 76 on second portion 14. The arcuate edge 72 flexes upwardly and defines an uppermost apex 82. Edge 66 is aligned such that it runs approximately collinearly with edge 52. Edge 68 is aligned such that it runs approximately collinearly with edge 54. The second portion 14 may be joined to the first portion 12 in any manner of known chemical, or mechanical, or non-chemical, and non-mechanical joining methods. Some exemplary mechanical manners of joining the first portion 12 with the second portion 14 include stitching or other sewing techniques. Exemplary chemical manners in which the first portion 12 may be joined to the second portion 14 include adhesive glues or thermal welding.

The third portion 16 is positioned in a similar manner such that it occupies space between second slit first edge 60 and second slit second edge 62. Rounded corner 70 of third portion 16 is positioned proximate the innermost terminal end of second slit 50. Edge 66 is closely aligned with edge 60 and edge 68 is closely aligned with edge 62. Moreover, corner 64 is aligned with corner 74 of third portion 16, and corner 67 is generally proximate corner 76 of third portion 16. Arcuate edge 72 is flexed upwardly to define apex 82 which is at a height similar to that of apex 82 on second portion 14. Inasmuch as the inner terminal ends of the first slit 48 and the second slit 50 are spaced apart, a region 84 is defined on the first portion 12 between second portion 14 and third portion 16. First portion 12 may be folded such that the region 84 is positioned above edge 18 and edge 20 on first portion 12. As will be described in greater detail below, region 84 will extend over the thumb crotch region of a person donning the glove such that the region of first portion 12 offset to one side of region 84 extends over the palmar area of a hand and the opposite region of the first portion 12 and opposite region 84 extends over the dorsal side of a hand.

Figure 3:
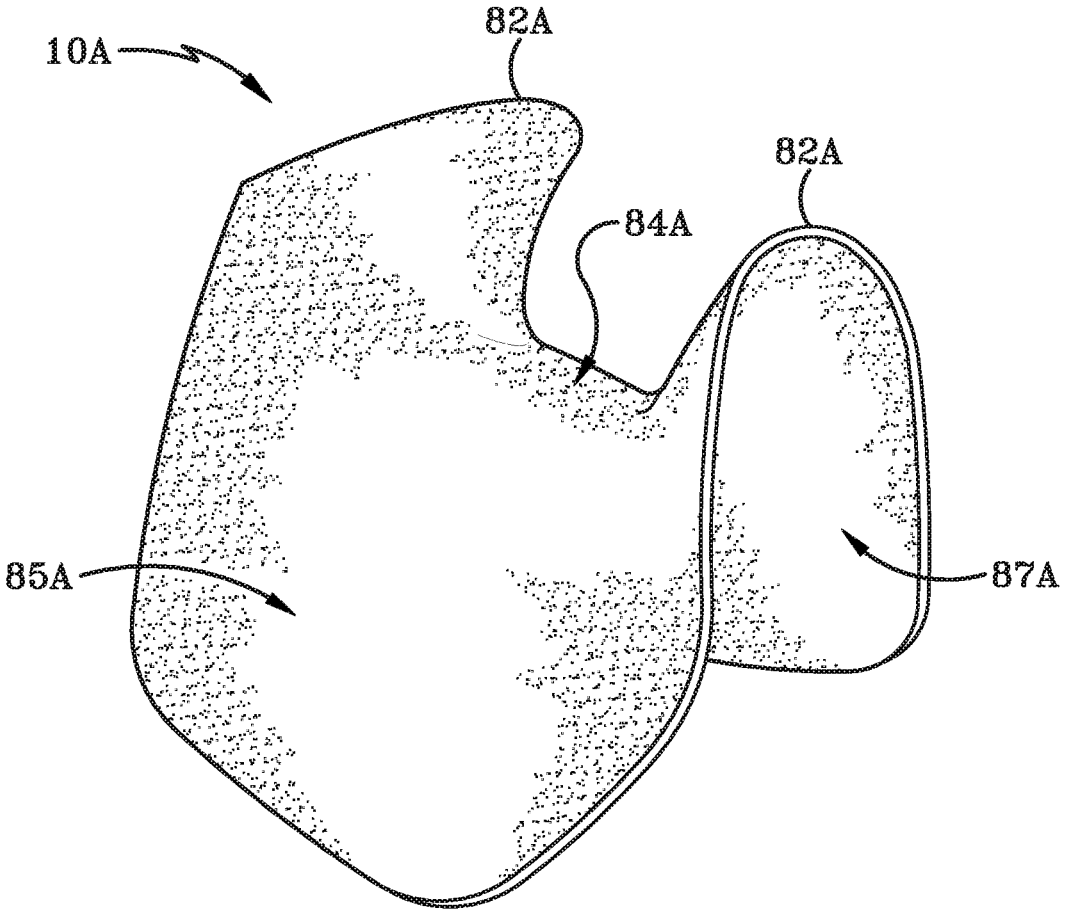
FIG. 3 is a perspective view of an alternative embodiment of the protective member.

FIG. 3. Depicts an alternative embodiment of a protective member for use with a liquid proof and heat resistant glove and is shown generally at 10A. Protective member 10A is similar to protective member 10 inasmuch as it fits over the thumb crotch region to protect the person wearing the glove, however it is formed from a monolithic unibody material. Protective member 10A may be molded in a manner such that its shape is similar to the assembled protective member 10 depicted in FIG. 2. Protective member 10A includes a first region 85 that is configured to fit over the palmar region of the wearer's hand when worn. A second region 87 of protective member 10A is configured to lie above the dorsal (or volar) region of a user's hand when donning the glove. In this scenario, the protective region 84 is positioned over the thumb crotch 104 region of the user's hand.

The protective member 10, 10A of the present disclosure can be formed from a variety of materials configured to withstand a sharp object passing over top surface 34 thereof. Protective member 10 or 10A may be formed from a hardened plastic or polymer, however other materials may be utilized. Two alternative materials that may be used to form protective member 10 or 10A are an aramid or a para-aramid synthetic fiber. One exemplary para-aramid material is sold under the name Kevlar® manufactured by the E. I. du Pont de Nemours and Company of Wilmington, Del. A further contemplated alternate material that may be used to form the protective member 10, 10A is chainmail. Protective member 10, 10A is adapted to withstand melting, ignition, and combustion in air at standard reference conditions, at temperatures of at least 500 degrees Fahrenheit, and perhaps able to withstand higher temperatures up to 1000 degrees Fahrenheit.

In accordance with the present disclosure, the protective member 10, 10A is configured to be formed within a glove, as will be described in greater detail below, in order to protect the user who has donned the glove from a hot, sharp, elongated member such as a blade passing over the thumb crotch region of the glove (see FIG. 10). While it is to be understood that this protective member 10, 10A is integrally molded within the glove such that it is positioned between a liner and an outer surface of liquid proof and heat resistance material (i.e., sandwiched between the inner liner and the outer surface), it is entirely possible for the protective member to be attached externally to the glove as previously described in the parent disclosures from which this disclosure is a continuation in part.

Figure 4:
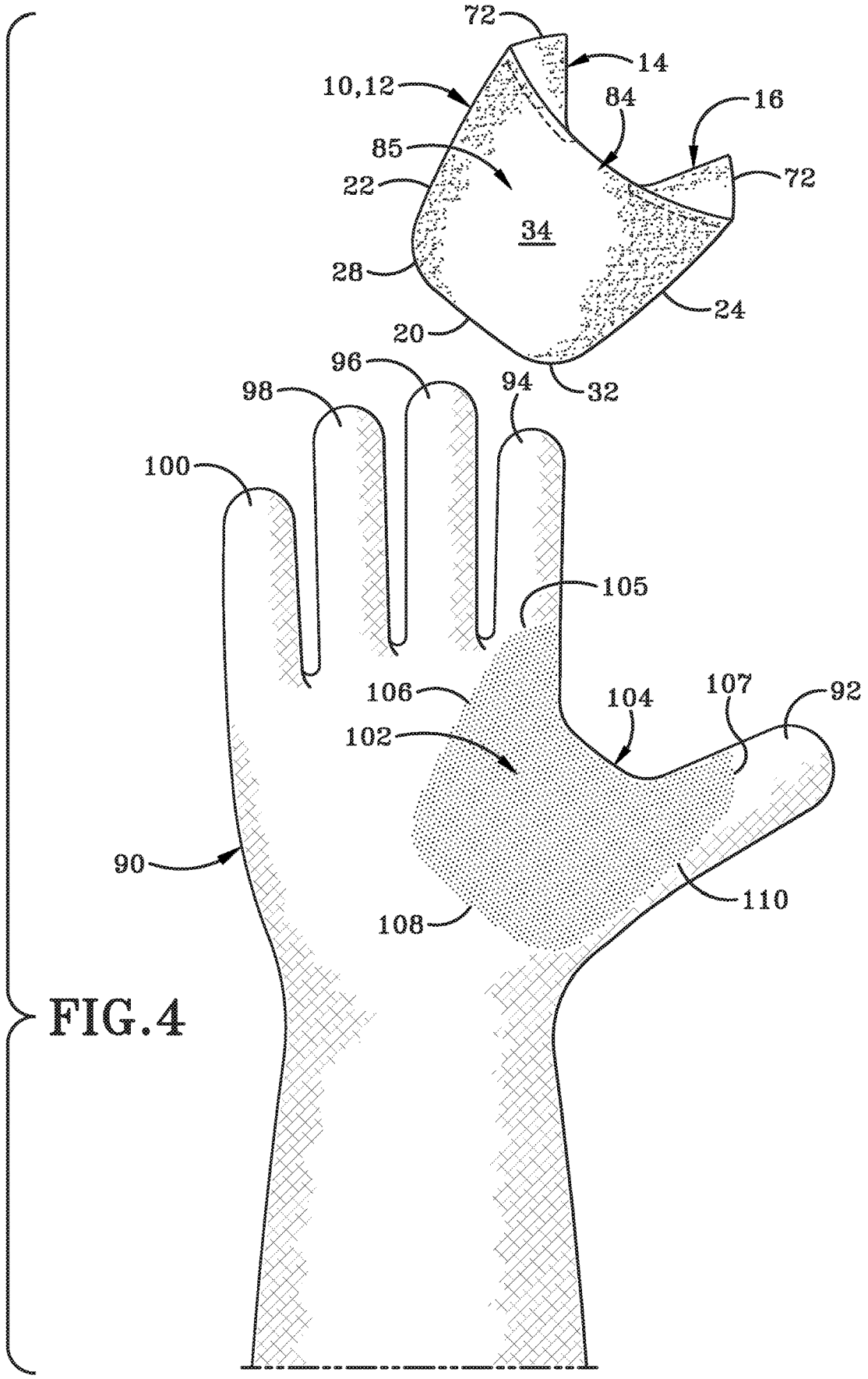
FIG. 4 is an exploded environmental view of the assembled protective member and a liner for a glove detailing the location where the protective member is attached to the liner.

FIG. 4 is an exploded view of the palmar side of a right handed glove liner 90. The liner 90 defines a thumb sleeve 92, an index finger or forefinger sleeve 94, and three other finger sleeves 96, 98, and 100. The liner 90 may be formed of liner material described in the parent disclosures or from another material as one having ordinary skill in the art would understand. One non-limiting exemplary material includes cotton twill, which provides for easy donning and doffing. Liner 90 has an inner surface defining a hand-shaped cavity adapted to receive the hand of a user/wearer/operator 123.

The liner 90 defines a region to be protected by the protective member 10, 10A and is shown generally by stippling/shading and identified generally at 102. The region to be protected 102 includes the thumb crotch 104. Region to be protected 102 includes a forefinger boundary edge 105 that extends along a portion of the forefinger sleeve 94 and covers the knuckle joint where the forefinger proximal phalange bone meets the metacarpal bone of the forefinger of the wearer's hand. The forefinger boundary edge 105 extends approximately 180° around the longitudinal axis associated with the forefinger. Additionally, the forefinger boundary edge 105 is disposed between the knuckle joint and the forefinger intermediate phalange bone. Stated otherwise, forefinger boundary edge 105 is positioned proximally relative to the distal tip of the forefinger sleeve 94.

The region to be protected 102 further includes a thumb boundary edge 107 that extends along a portion of the thumb sleeve 92 and covers a portion of the knuckle joint where the proximal thumb phalange bone meets the metacarpal bone of the thumb. The thumb boundary edge 107 extends approximately 180° around the longitudinal axis associated with the thumb. Additionally, the thumb boundary edge 107 is disposed between the knuckle joint and the thumb distal phalange bone. Stated otherwise, thumb boundary edge 107 is positioned proximally relative to the distal tip of the thumb sleeve 92.

The region to be protected 102 extends around and over the thumb crotch 104 such that the region to be protected 102 partially covers a palmar portion and partially covers a dorsal portion of the wearer's hand. With respect to the palmar side, the region 102 to be protected includes a palmar first edge boundary 106, a palmar second edge boundary 108, and a palmar third edge boundary 110.

For the following discussion, some anatomical terms are utilized to identify locations of components of the present disclosure relative to anatomical positions. Components of the present disclosure that are closer to the radius bone of the forearm are referred to herein as "radial" or "radially" relative to other components. Components of the present disclosure that are closer to the ulna bone of the forearm are referred to herein as "ulnar" or "ulnarly" relative to other components.

The palmar first edge boundary 106 extends ulnarly from an angled orientation with the forefinger boundary edge 105. The ulnar-directed extension of the palmar first edge boundary 106 is positioned above the third metacarpal bone (related to the middle finger). The palmar first edge boundary 106 crosses over the third metacarpal bone at an angle between 15° and 75°. In one particular implementation, the palmar first edge boundary 106 crosses over the third metacarpal bone at an angle of about 60° relative to horizontal. The ulnar-directed extension of the palmar first edge boundary 106 terminates proximately above the fourth metacarpal bone (related to the ring finger).

The palmar second edge boundary 108 extends radially from the terminal end of the palmar first edge boundary 106. In one implementation, the palmar second edge boundary 108 meets the palmar first edge boundary 106 at a rounded approximate 90° angle. The radial-directed extension of the palmar second edge boundary 108 is positioned above the third metacarpal bone proximal from the palmar first edge boundary 106. The radial-directed extension of the palmar second edge boundary 108 terminates proximately above the proximal base of the first metacarpal bone (related to the thumb).

The palmar third edge boundary 110 meets the terminal end of the palmar second edge boundary 108 at a rounded approximate 90° angle. The palmar third edge boundary 110 extends distally above the longitudinal axis of the first metacarpal bone. The palmar third edge boundary 110 meets thumb boundary edge 107 above the proximal thumb phalange and proximal relative to the distal thumb phalange.

The aforementioned region to be protected 102 has been described by the respective edge boundaries with respect to the palmar side of the hand, however the region to be protected 102 is to be understood as being similarly shaped on the dorsal side of the hand, and the generally mirrored shape on the dorsal side is not repeated herein for brevity.

Figure 5A:
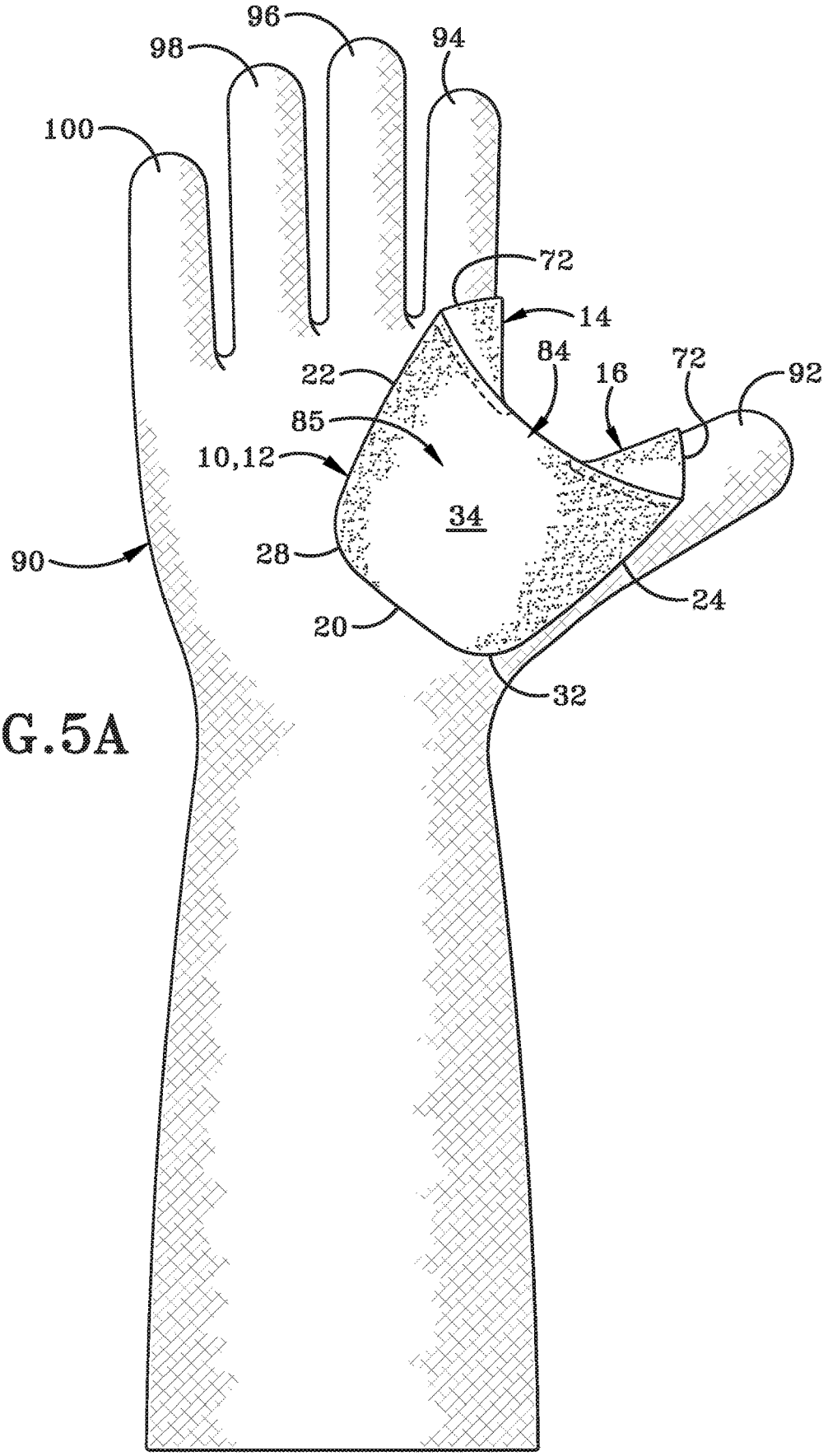
FIG. 5A is a palmar-side view of the protective member attached to the liner.

As depicted in FIG. 5A, the protective member 10 connects with the liner 90 such that the protective member 10 is positioned directly above the region to be protected 102. More particularly, a first protecting region 85 of protective member 10 is positioned to protect at least a portion of the palmar side of the wearer's hand. As such, when the protective member 10 is attached to the liner, certain components are positioned relative to the wearer's hand.

In one implementation, the protective member 10 is connected with the liner in any known chemical manner, mechanical manner, or non-chemical and non-mechanical manner. For example, the protective member 10 may be chemically adhered or bonded with the liner 90, or the protective member 10 may be mechanically fastened with the liner 90.

With the protective member 10 attached to the liner 90, the third edge 22 lies directly above the palmar first edge boundary 106 such that the third edge 22 extends ulnarly above the third metacarpal bone at an angle between 15° and 75°. The corner 28 is positioned closely adjacent to directly above the center of the third metacarpal bone. The second edge 20 extends over the second metacarpal bone aligned with palmar second edge boundary 108. The fourth edge 24 is aligned with palmar third edge boundary 110 such that the fourth edge 24 extends distally above the longitudinal axis of the first metacarpal bone. The edge 72 on the third portion 16 is aligned with the thumb boundary edge 107 above the proximal thumb phalange and proximal relative to the distal thumb phalange and extends 180° around the ulnar-facing side of the longitudinal axis of the thumb sleeve 92. On the other side of the protective member 10, the edge 72 of the second portion 14 is aligned with forefinger boundary edge 105 to extend 180° around the radius-facing side of the forefinger. This alignment positions the protecting region 84 directly above and over the thumb crotch 104 of liner 90.

Figure 5B:
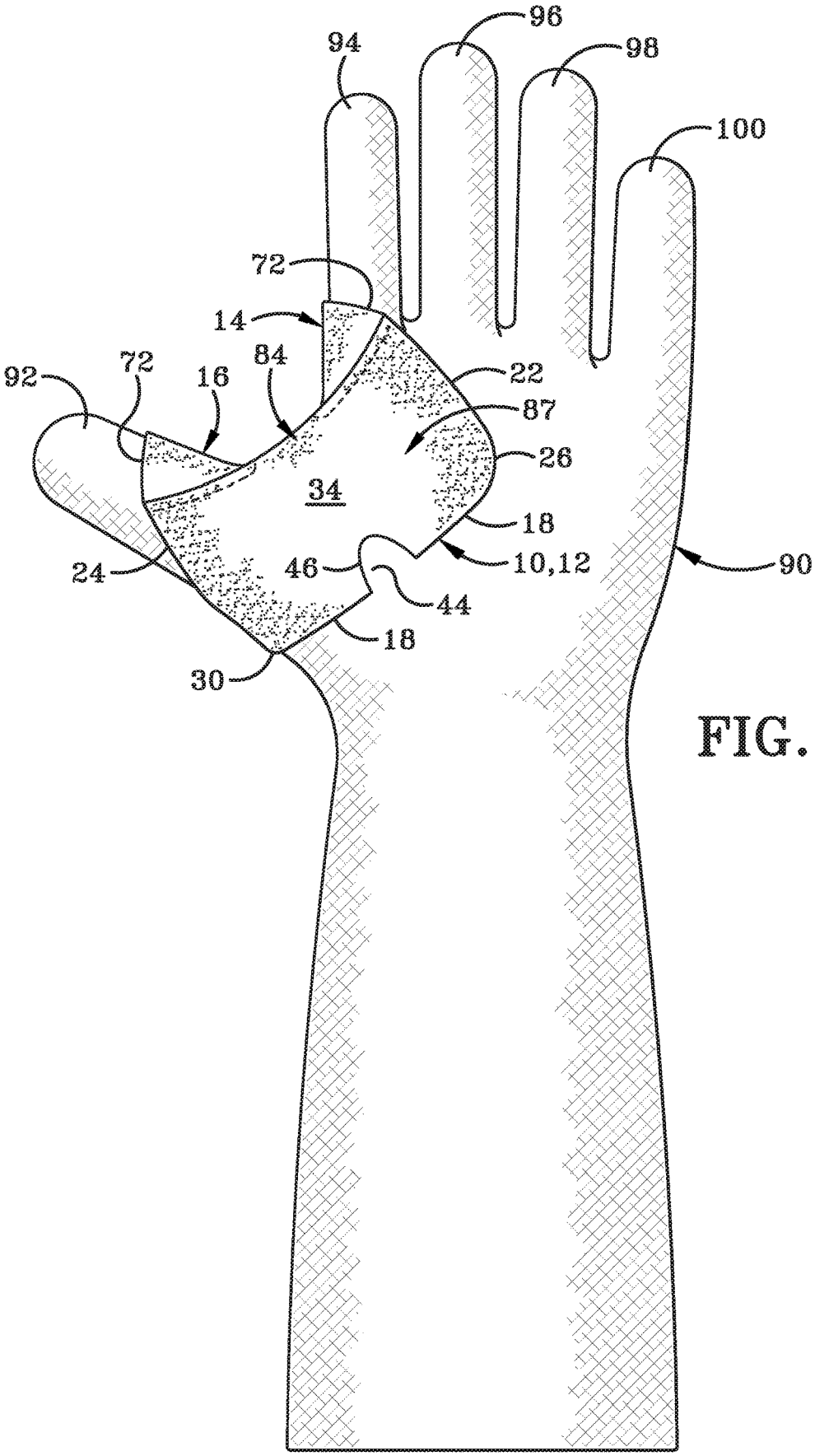
FIG. 5B is a dorsal-side view of the protective member attached to the liner.

As depicted in FIG. 5B, a second protecting region 87 of protective member 10 is positioned to protect at least a portion of the dorsal side of the wearer's hand. Namely, the third edge 22 extends ulnarly at an angle between 15° and 75° crossing over the third metacarpal bone. The first edge 18 extends radially at an angle generally orthogonal to that of the third edge 22. As such, the first edge 18 crosses over the second metacarpal bone at an angle equal to 90° less the angle of the third edge 22. Thus, if the third edge 22 crosses the third metacarpal at about 60° relative to horizontal, then the first edge 18 crosses the second metacarpal at about 30° relative to horizontal.

With respect to the dorsal side, the arcuate edge 46 defining cutout region 44 assists with the flexibility and bending of protective member 10 during its use. As indicated previously in the parent references (from which this is a CIP), the liquid proof and heat resistant glove carrying protective member 10 is preferably used in a delicatessen for removing rotisserie chickens from a rotisserie spit. A deli worker dons these gloves prior to removing the chickens (or any type of poultry) from the spit. To remove a chicken from a spit, a worker wearing the liquid proof heat resistant gloves removes the spit from the rotating oven. The worker then grasps the spit at one end. Ordinarily, a right handed person grasps the right end with his right hand and grasps adjacent the right end of the spit with his left hand in the glove. This spit is then positioned above the thumb-crotch region of the left-hand glove. The user then pulls the spit using his right hand in a motion similar to drawing a sword, all while continuing to grasp the spit with his left hand. As the spit travels over the left-hand thumb crotch region through the user's grasped hand, the chickens are released from the spit and fall into a desired container. The protective member 10 protects the user's hand during this motion.

Figure 6:
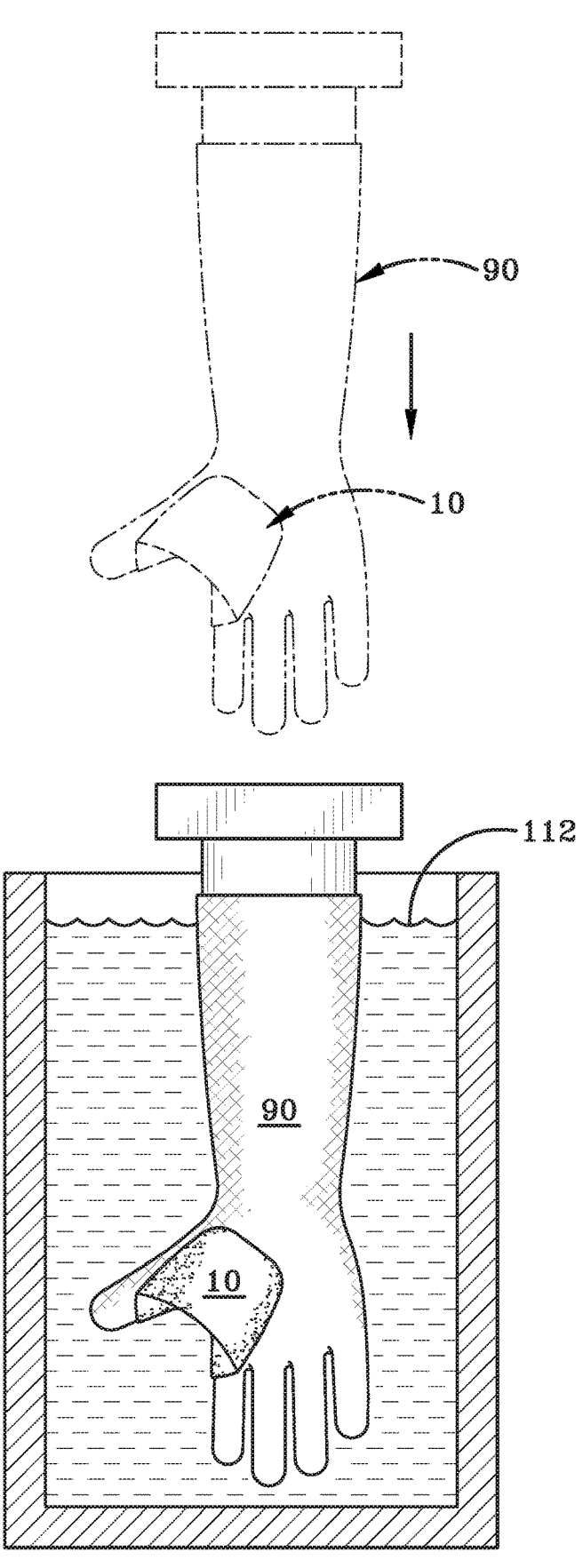
FIG. 6 is an operational view of the liner carrying the protective member being dipped into a bath of liquefied material which cures to form the outer layer of the glove.

FIG. 6 depicts one exemplary method of manufacture for the glove carrying protective member 10. After the protective member 10 has been connected to the liner 90, as described above, the liner may be dipped into a liquefied bath of glove material. This effectively seals the protective member 10 between the liner 90 and an outer surface material layer 112. The outer surface material layer 112 is liquid proof and heat resistant as one having skill in the art would understand, and when cured defines an assembled glove 114.

With continued reference to FIG. 6, and in accordance with one embodiment, the protective member 10 is impermeable. Thus, during the manufacture of the glove, the impermeable and integrally formed protective member 10 is intermediate and sandwiched between the inner liner and outer skin. Protective member 10 is positioned in the thumb webbing region formed of a third material different than the material of the inner liner and the material of the outer skin, wherein the protective member is positioned entirely beneath the outer skin such that the protective member is not viewable when looking at the outer skin of the glove, and wherein the impermeability of the protective member prevents the outer skin from striking therethrough when forming the outer skin by dipping the inner liner and protective member in the liquefied material of the outer skin.

Figure 7A:
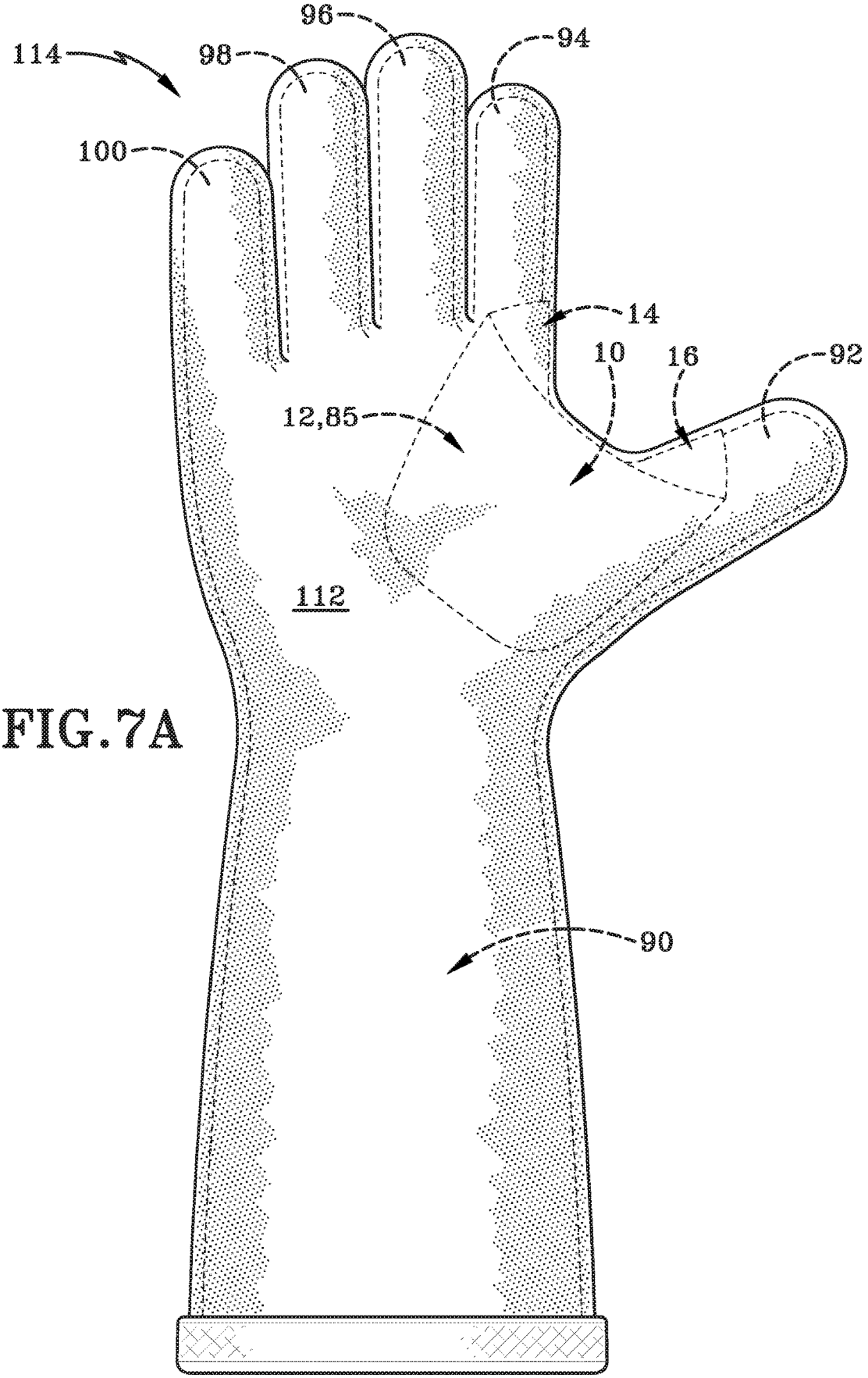
FIG. 7A is a palmar-side view of the assembled liquid proof and heat resistant glove having a protective member extend over and around the thumb crotch of the glove in order to protect the same.
Figure 7B:
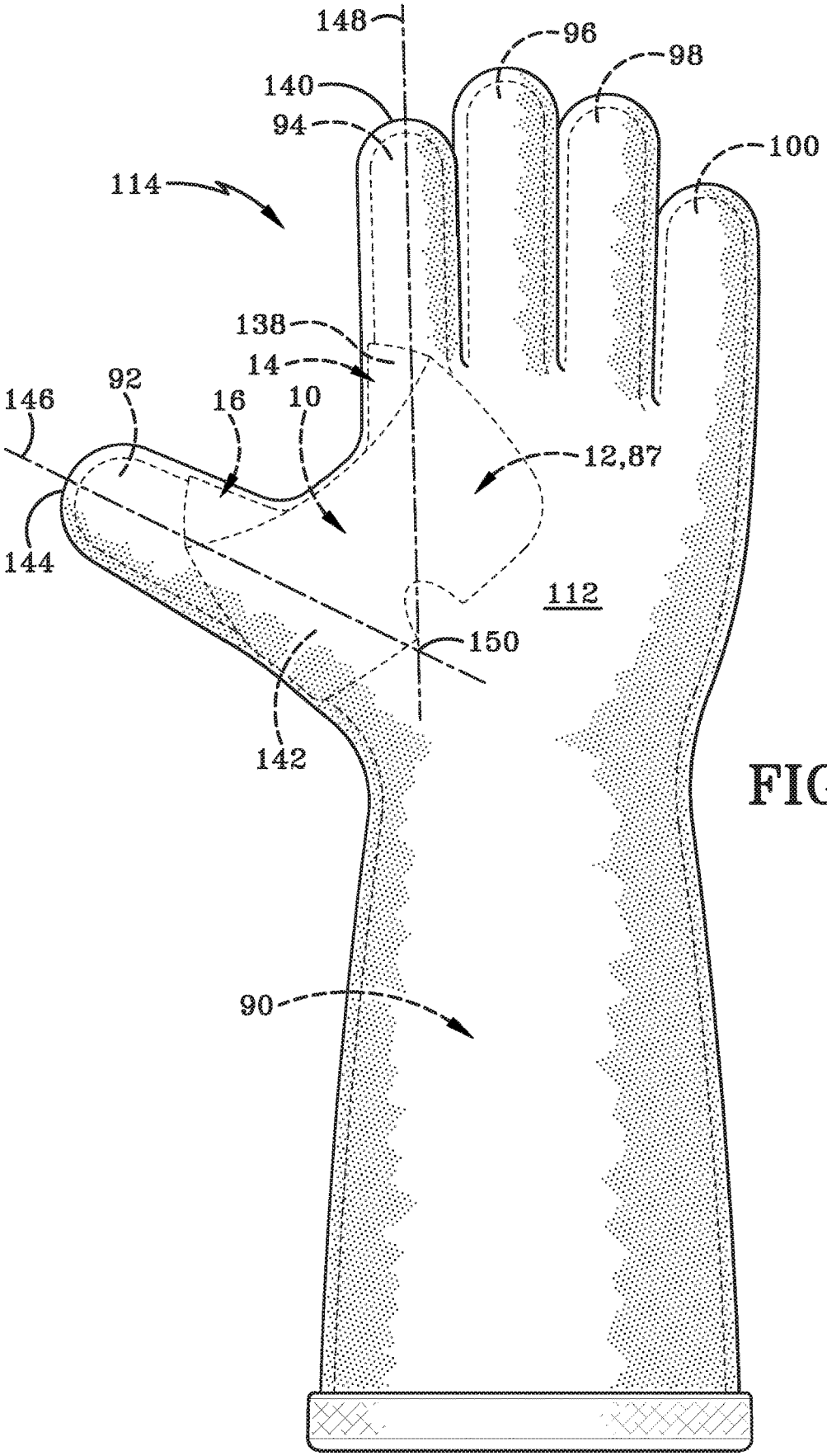
FIG. 7B is a dorsal-side view of the assembled liquid proof and heat resistant glove having a protective member extend over and around the thumb crotch of the glove in order to protect the same.

FIG. 7A and FIG. 7B represent an assembled liquid proof and heat resistant glove 114 in accordance with the present disclosure. The protective member 10 is shown in dashed-lines representing that it is secured and sealed below the outer surface material layer 112 and protects the thumb crotch of the same. However, while protective member 10 is sealed within the glove between the inner liner and the outer surface material 112, it may be visually undetectable. In accordance with another aspect of an exemplary embodiment of the present disclosure, a glove that is liquid proof and heat resistant may provide additional features to enable a person or workman wearing the glove visually identify a cut, rip, tear, or slice, or other rupture in the glove. It is envisioned that the outer layer 112, the protective member, and the inner liner may have differing colors so as to easily identify the glove failure has occurred. Glove failure may be caused by the slicing motion of the spit moving across the thumb crotch region atop the outer surface defined by the outer skin.

As depicted in FIG. 7B, the index finger sleeve 94 includes a base 138 and a closed tip 140. The thumb sleeve 92 includes a base 142 and a closed tip 144. A first longitudinal axis 146 extends through the base 142 through the closed tip 144 of the thumb sleeve 92. A second longitudinal axis 148 extends through the base 138 and a closed tip 140 of the index finger sleeve 94. A vertex 150 is located at the intersection of the first longitudinal axis 146 and the second longitudinal axis 148. In one example, the angle associated with the vertex located between the first axis 146 and the second axis 148 is an acute angle. In another example, the angle between the first axis 146 and the second axis 148 is in a range from about 45° to about 85°. In another example, the angle between the first axis 146 and the second axis 148 is in a range from about 55° to about 75°. In another example, the angle between the first axis 146 and the second axis 148 is in a range from about 55° to about 65°. In another example, the angle between the first axis 146 and the second axis 148 is in a range from about 60°. In one non-limiting scenario, the aforementioned angles may be critical to identify the thumb crotch region of the glove 114 and ensure the proper placement of the protective member therein, as will be described in greater detail below.

A thumb crotch region is defined between the first longitudinal axis 146 and the second longitudinal axis 148. Additionally, the thumb crotch region extends around from the palmar side to the dorsal side of the glove 114 between the index finger sleeve 94 and the thumb sleeve 92. As discussed previously, the protective member 10 is located in the thumb crotch region disposed between the outer layer 112 and the inner liner 90. The protective member 10, in some embodiments, may be a different color than the outer layer 112. The different color of the protective member 10 is adapted to visually alert operator 123 in the event of a glove failure occurrence in the outer layer 112 in the thumb crotch region located between the first axis 146 and the second axis 148. Furthermore, the major surface area of surfaces 34, 36 on protective member 10 occupy all or at least most of the thumb crotch region.

In one exemplary embodiment, the outer layer 112, which may also be referred to herein as outer skin 112, has a color that is the darkest relative to the other colors provided on the inner liner 90 and the protective member 10. Thus, for example, if the outer skin 112 is a first color, the protective member 10 is a second color, and the inner liner 90 is a third color, then the first color is the darkest, such as a dark brown, black, dark green, dark blue (i.e., navy), or dark red, or the like. The second color of the protective member 10 is different from the first color and may have other color appearance parameters. In one example, the second color has a different lightness than the first color of the outer surface of the outer skin 112. In a more specific example, the lightness of the second color is lighter than the first color. In another example, the chrominance of the second color of member 10 is farther away from a dark chrominance of the outer surface of the outer skin 112 (i.e., the first color). Stated otherwise, a chrominance of the second color is farther away from dark chrominance than the first color. The hue of the first color may be darker than the hue of the lighter second color. In another particular example, the protective member 10, which is a second color, may be less saturated when viewed from the outside so as to exhibit a higher brightness and colorfulness in the light than the outer skin 112, which is the first color. In this example, when the colorfulness of the second color effectuates a higher brightness, it may be technically possible for the first color to be the same (color) even though it effectuates and exhibits a lower brightness. This may be accomplished if the second color and the first color are similar, but since the outer skin 112 is made from a different material than the protective member 10, the manner in which the light hits and reflects from the differing materials that form the outer skin 112 and protective member 10, causes the light to exhibit different reflective properties so as to observably change the color, as perceived by the user. Additionally, the protective member 10 may include reflective properties to reflect light against a dark absorptive backdrop of the outer layer 112. Stated otherwise, the outer layer 112 may be formed from a material that absorbs more light than the protective member 10. The protective member 10 may include a material that reflects more light than the outer surface of outer layer 112. Additionally, the third color associated with the inner liner 90 may be different than the first and second colors, or it may be the same color as the second color. Typically, the inner liner is white inasmuch as it is usually made from drilled cotton.

In each scenario, the purpose of the color of the protective member being lighter than the color of the outer layer 112 is to enable the user to readily and easily identify a portion of the glove failure, such as the rip, tear, slice, or other rupture/failure in the outer layer. This may be important because if the outer layer 112 of the glove fails, then the outer skin 112 may no longer be liquid proof. Thus, if the there is a glove failure and a worker submerges their hand into a vat of hot cooking grease at temperature upwards of 700° F., then there is a significant likelihood that serious injury can occur to the wearer's hand (see FIG. 11). If the worker wearing the glove identifies the failure by visually spotting the failure to the prominence of the lighter color on the protective member showing through the rupture, then the worker can remove the glove, dispose of the glove, and replace the glove with another glove that is new, unadulterated, and liquid proof (see FIG. 12).

In one non-limiting exemplary embodiment, the lighter second color of the protective member may be critical inasmuch as it is easier to identify a lighter color against a dark backdrop rather than a darker color against a light backdrop. This is especially useful in a commercial food preparation setting where the gloves are often dirty, covered in grease, or other seasonings of the rotisserie chickens. Thus, it may not be advantageous to have a light colored glove with a dark protective member because gloves will be dirty and have various seasonings and grease thereon. A tear in a light colored glove would not be as easily identified if the underlying protective member was darker because it would simply look like cooking remnants, such as seasonings, flavoring, or chicken parts. Whereas if the second color is lighter than the outer skin (i.e., the third color), then the bright or light color of the protective member showing through the glove rupture would be readily determined and easily identifiable by the wearer. Essentially, the glove establishes a color splash effect when the glove fails. A color splash effect is when there is a substantial dark background (usually black or heavy grey tones), and a single isolated brighter color that is prominent and surrounded by the dark background. In the realm of photography, a color splash effect is accomplished by isolating one single color and converting the rest of the photograph to black and white. The lighter colored layers beneath the outer surface create the same effect when seen through the glove failure (i.e., cut, slice, tear, rip, or rupture, etc.).

In one exemplary embodiment, the second color associated with the protective member 10 is green, such as a light green or neon green. In this instance, the color associated with the outer skin 112 may be a dark color, such as black. The green of the underlying protective member is easily identifiable via visual human inspection against the dark outer surface of the glove in the event there is a rupture.

Figure 8:
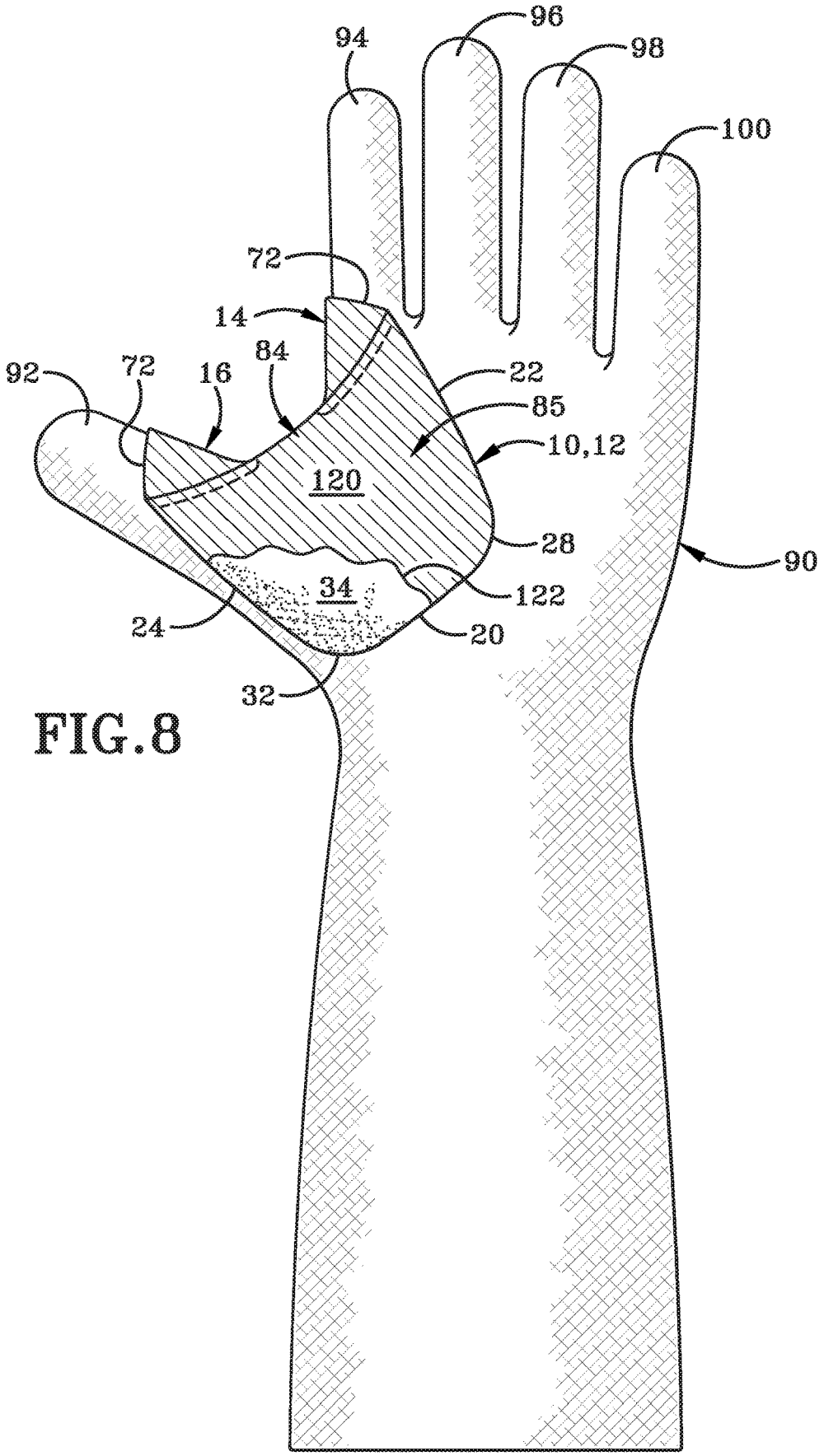
FIG. 8 is a palmar side view of a liner with the protective member attached thereto that is painted or otherwise colored with a second color that is different than the first color of the outside layer of the glove.

FIG. 8 depicts a palmar view of a left-hand liner 90 with protective member 10 located in the thumb crotch region thereof. Protective member 10 is attached to liner 90 in a manner described above such as through adhesive or other mechanical means, such as stitching. Protective member 10 has a different color than liner 90. In this example of FIG. 8, protective member 10 is colored with paint 120 substantially covering the outer surface of protective member 10. A breakaway line 122 is represented to indicate that paint 120 is a separate layer from the protective member 10 and has a different color than the surface 34. However, it is to be entirely understood that the painted layer 120 on protective member 10 is not necessary and the color differential between protective member 10 and the inner liner 90, as well as the protective member 10 and the outer layer 112 may be integrally formed with the protective member 10 itself. Effectively, FIG. 8 provides an alternative embodiment for which to color protective member 10. The manner in which the protective member 10 is painted to effectuate the neon green color, which is also referred to as second color 120, may be accomplished in a variety of different ways one in the ordinary skill of the art would understand. In one example, the painted layer 120 could be applied prior to attaching the protective member 10 to liner 90. In an alternative embodiment, the protective member 10 may be painted to effectuate the green second color 120, or painted layer, after the protective member 10 has been attached to liner 90. In one example, the painted layer creating the green second color 120 is only applied over the surface 34 of protective member 10. However, it is entirely possible for the second color 120 to completely surround the entire protective member 10 such that the second color 120, which may be green or another neon color, covers second surface 36 of protective member 10. While the second surface 36 is not shown in FIG. 8, it is to be understood that the shape of the protective member 10 (as identified in FIG. 2) could be entirely coated with the second color 120 by dipping the protective member 10 into neon green paint prior to installation on liner 90 to entirely cover the same. It is even possible to apply a different neon color to the second surface of protective member 10 such that the second color 120 is different than a neon color located below the protective member 10 intermediate the liner 90 and second surface 36 of protective member 10.

Figure 9:
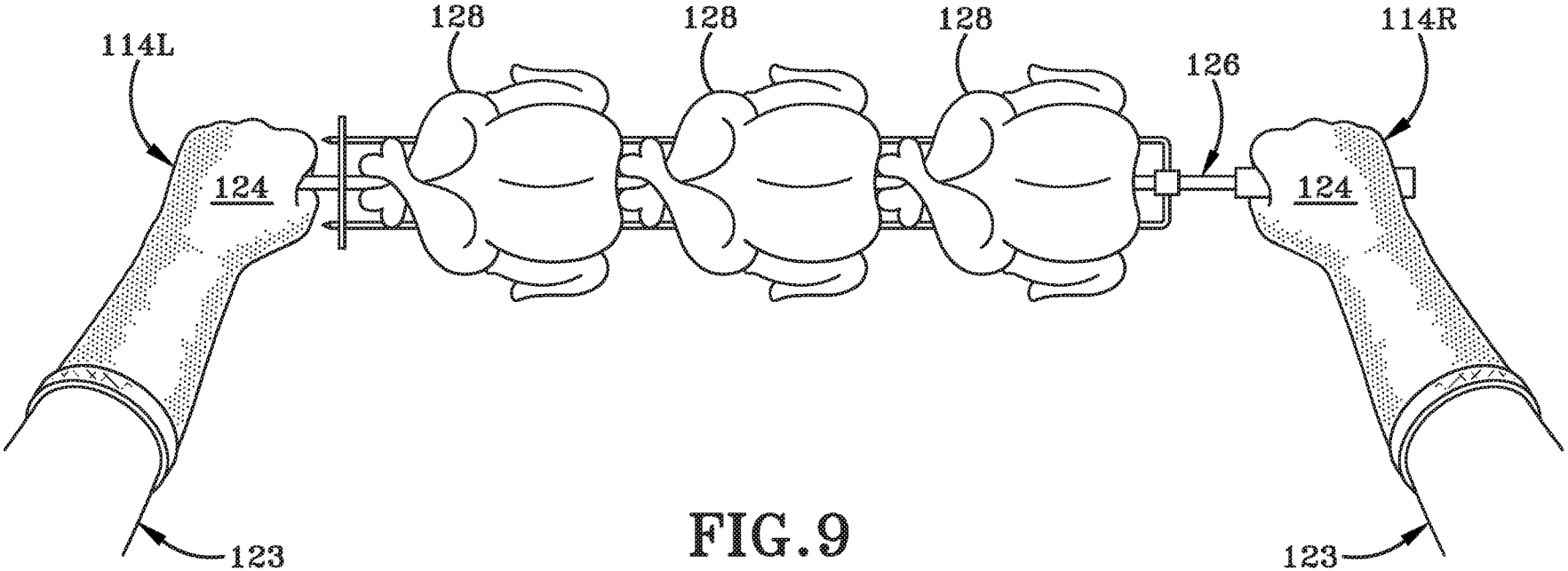
FIG. 9 is a diagrammatic view of an operator using two gloves to hold a rotisserie spit with cooked chickens thereon.
Figure 10:
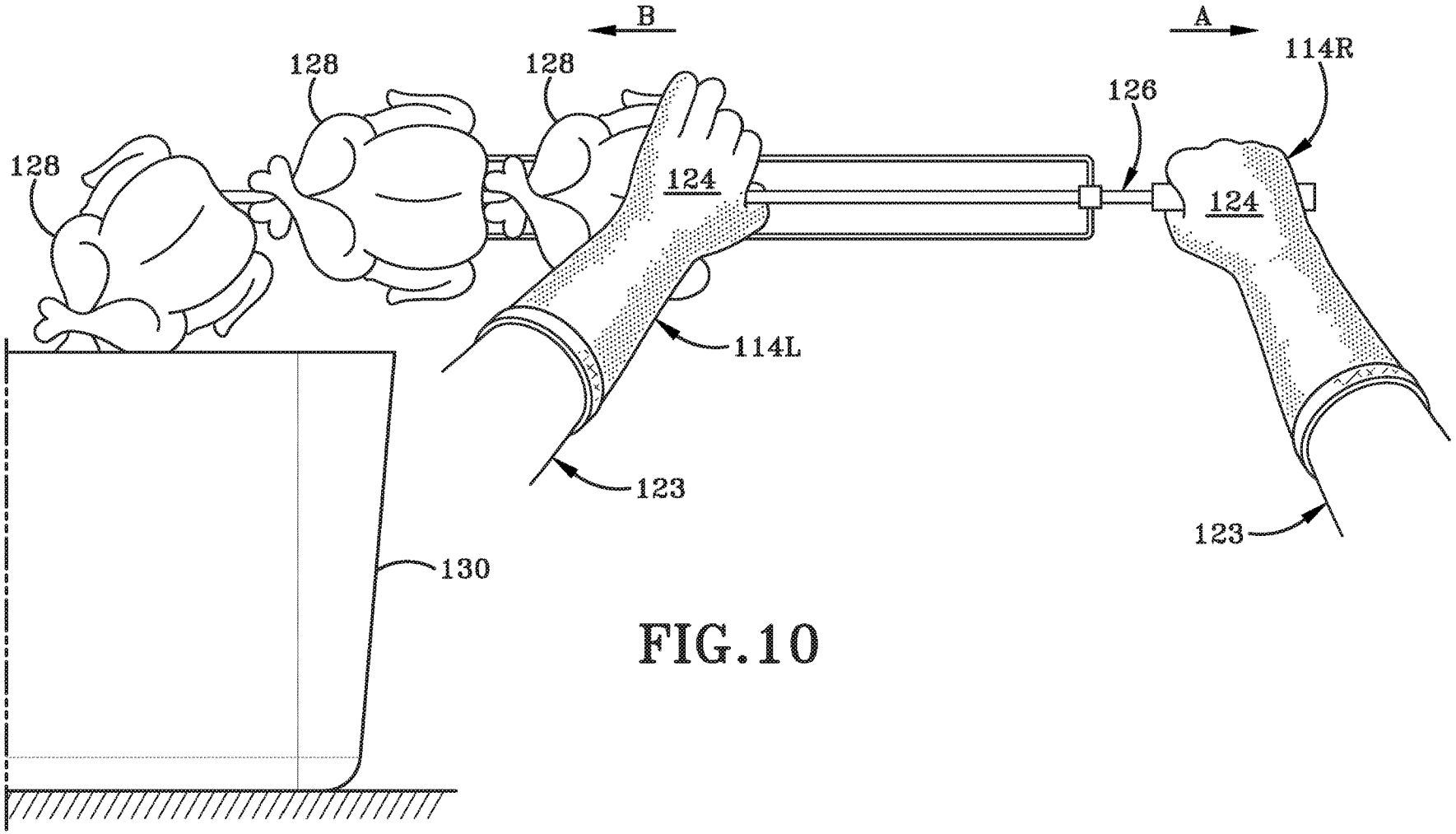
FIG. 10 is an operational view of chickens being removed from the rotisserie spit while wearing the liquid-proof and heat-resistant gloves in accordance with the present disclosure.

FIG. 9 and FIG. 10 depict operational diagrammatical views of the gloves 114 in accordance with the present disclosure in use. Inasmuch as the gloves 114 are liquid-proof and heat-resistant, they are typically beneficial for use in delicatessens and other restaurant service industries where the wearer 123 is subjected to hot liquids, such as grease and oil from frying foods and cooking chickens, among other food items. FIG. 9 depicts an operator 123 wearing a left-hand glove 114L and a right-hand glove 114R. The left-hand glove 114L and the right-hand glove 114R include the protective member 10 described herein that has a second color 120 that is different than a first color 124 associated with the outer skin 112, which is also referred to as the outer layer 112. The operator 123 may grasp a spit 126 associated with a rotisserie cooking device for cooking chickens 128 thereon. The user will grasp a left end of the spit 126 with his left hand wearing glove 114L and grasp a right end of the spit 126 with his right hand wearing right-handed glove 114R.

To remove chickens 128 from the spit 126, the operator 123 will move his left hand wearing the left-hand glove 114L near the right end of spit 126. Adjacent the right hand wearing right-hand glove 114R, the operator 123 will place the spit 126 in the thumb crotch region of his left glove 114L. The operator 123 wraps his fingers around the spit 126 so as to position spit over the thumb crotch region of the glove between the index finger sleeve and the thumb sleeve of glove 114L. The material forming the protective member is more resistant to failure than the outer skin 112 when a sharpened edge of spit 126 is contacted with the outer layer or skin 112 and moved over the protective member 10. In another embodiment, the material forming protective member 10 may be more rigid than the outer layer 112.

As depicted in FIG. 10, the operator 123 will maintain a tight grip with his right-hand glove 114R near the right end of the spit 126 and pull the spit 126 towards the right as indicated by arrow A. Simultaneous to the pulling of the right end of the spit 126 in the direction of arrow A, operator may maintain his left-hand grasp with left-hand glove 114L around the spit 126 in the thumb crotch region of glove 114L. Simultaneous to the pulling of the spit 126 in the direction of arrow A, the chickens 128 are released from their connection with the spit 126 and moved in the direction of arrow B, which is opposite that of arrow A. Chickens 128 are released from the spit 126 and are deposited into a storage container 130 for packaging and display at the deli so a consumer may purchase them from a heated display case.

Figure 11:
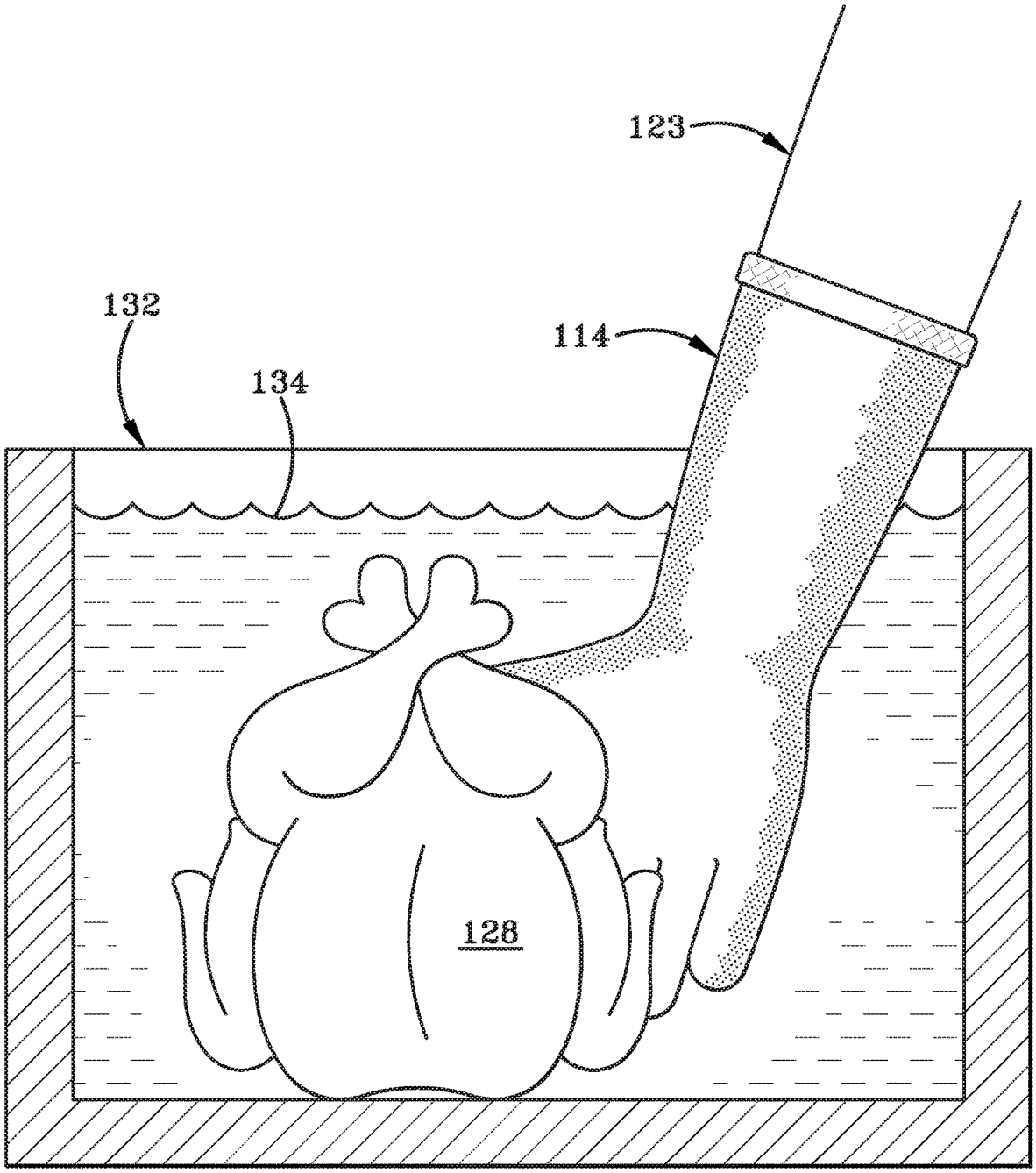
FIG. 11 is an operational diagrammatical view of the glove in accordance with the present disclosure being used to reach into a cooking device having hot liquid therein.

As depicted in FIG. 11, the gloves 114 associated with the present disclosure are typically multiuse gloves in cooking environments, such as delis and other fast food restaurants. Because the outer skin or outer layer 112 is both liquid-proof and heat-resistant, it is typical that the gloves 114 are used for other kitchen scenarios that require a user 123 to protect his hands. In one instance, a deep-fryer or other heating assembly 132 is typical in the kitchen, such as a deep-fryer containing extremely hot liquid 134, such as fryer grease or fryer oil. It is common for these oils 134 to reach very hot temperatures, often exceeding 400°. FIG. 11 shows glove 114 in use protecting a person's hand against injury during exposure to a hot liquid 134. Glove 114 is designed to extend for a distance beyond the wrist of the wearer and to terminate approximately midway between the wrist and elbow. Alternately, the glove may extend entirely up the length of the user's arm.

Because the gloves 114 have multiple purposes inasmuch as they can be used to remove chickens from a rotisserie spit 126 and as well to remove items from the bottom of a hot grease 134 deep-fryer 132, it is imperative that any rupture in the outer surface layer 112 be readily identified quickly because if the rupture occurs, then the outer surface layer 112 is no longer liquid impermeable. The hot liquid 134, such as hot grease, could enter into the glove when the wearer 123 reaches down into the deep-fryer 132 which would result in significant injury.

As indicated previously, glove 114 is designed for applications where protection is needed from one or more of hot, cold or caustic substances (or heat therefrom) that are able to penetrate into the interior of a conventional glove. It should be understood that the term "temperature resistant" or "heat resistant" used herein means resistance to both heat and cold, and the term "fluid impermeable" or "liquid proof" means impermeability or resistance to both liquids and gases. It will further be understood that glove 114 will also protect the wearer's hand from exposure to hot, cold and caustic solid materials but solid materials are less likely to be of such a nature that they are able to penetrate into the interior cavity of the glove through the seams. However, the glove 114 of the present disclosure will also substantially prevent particulate-type solid materials that are extremely hot, extremely cold or extremely caustic from penetrating into the interior cavity through the glove's seams. Consequently, the term "fluid" should also be considered, for the purposes of this description, to refer to particulate-type solid materials and "fluid impermeability" or "liquid proof" to refer to impermeability of the glove with reference to particulate-type solid materials.

Figure 12:
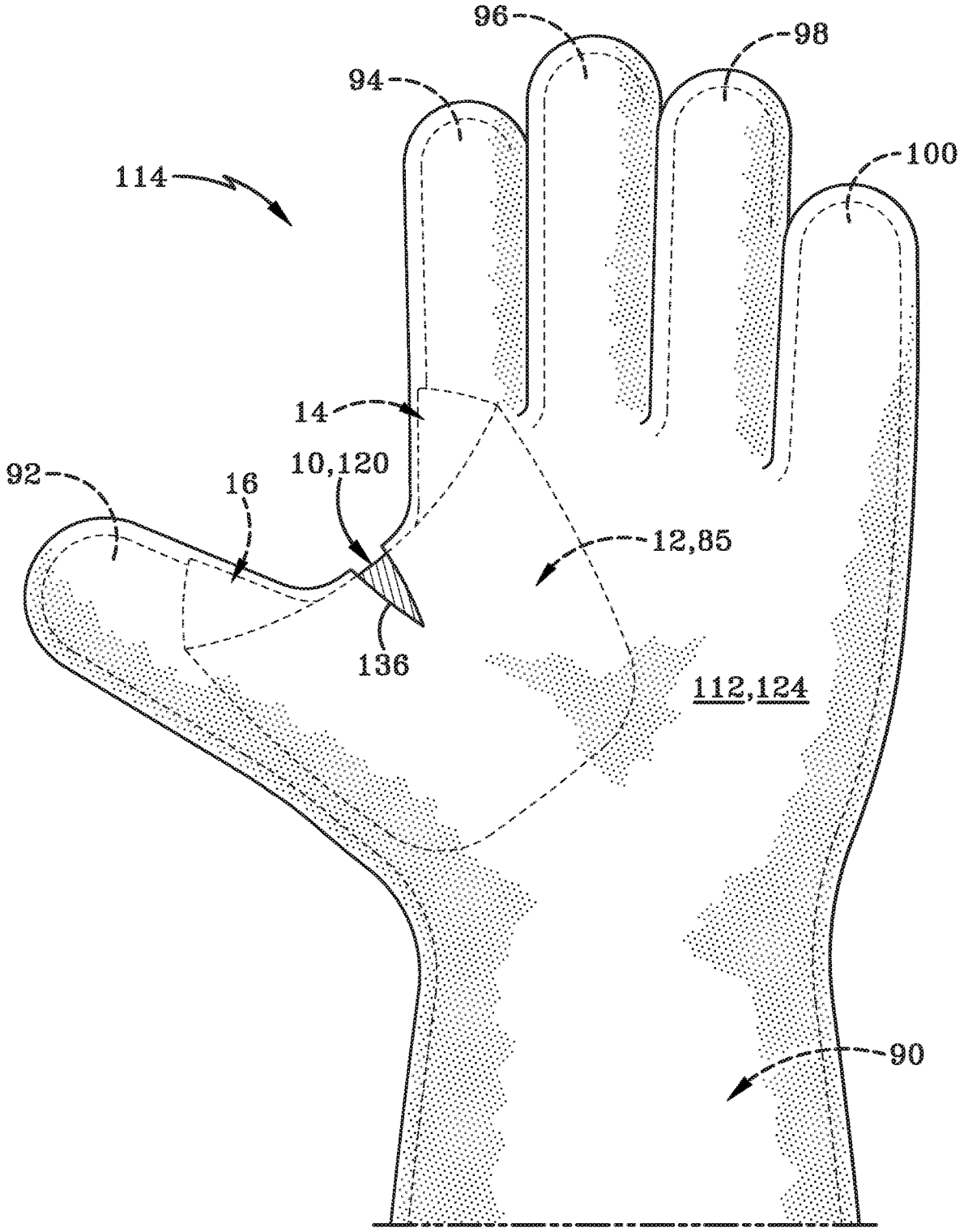
FIG. 12 is a palmar side view of a left-hand glove in accordance with the present disclosure depicting a rupture or tear in the thumb crotch region which reveals the protective member below the outer surface of the outer layer establishing a color splash effect by the lighter color of the protective member revealing itself against a darker backdrop of the outer material through the tear.

FIG. 12 depicts an exemplary rupture in the glove in the thumb crotch region resulting from drawing the spit 126 through the thumb crotch region of the left-hand glove 114L. The rupture in the thumb crotch region is shown generally at 136 which sometimes occur in the event the spit 126 is pulled over the outer surface of the outer layer 112. Because the protective member 10 has the second color 120 which is brighter than the first color 124 associated with the outer layer 112, the rupture or tear 136 is easily identified due to the color splash effect that is created by revealing the bright color of second color 120 through the tear 136. When the color is seen by the operator 123 to identify the tear 136, the glove 114 may be disposed of. The wearer 123 may get a new glove 114 to continue the performance of the job duties.

In accordance with another aspect of the present disclosure, the outer skin 112 of the glove that defines the outer surface is formed from a material that is liquid impermeable and withstands thermal deformation (i.e., melting) at a temperature of at least 300° F. In one example, the outer skin 112 is a polymer material that has a insulative value sufficiently high to protect the wearer of the glove from the hot grease contacting the outer surface. Thus, in addition to withstanding thermal deformation (i.e., melting), an insulation value (R-value) should be high enough to protect the wearer from injury at a temperature of at least 300° F. for about at least 15 to 30 seconds.

Insulative R-Value is typically measure in R-Value per inch. For example, polystyrene board has insulative R-values in a range from about 3.8 to about 5.0 R-Value/inch. In accordance with the present disclosure, the R-value of the material forming the outer skin need to be higher than traditional insulation because the outer skin is relative thin. Thus, in another exemplary embodiment, the insulative value for outer skin may be in range from about 10 R-value/inch to about 20 R-value/inch to accomplish the goal of protecting the wearer from injury at a temperature of at least 700° F. for about at least 15 to 30 seconds. In another example, the insulative value for outer skin may be in range from about 10 R-value/inch to about 200 R-value/inch to accomplish the goal of protecting the wearer from injury at a temperature of at least 700° F. for about at least 15 to 30 seconds. In another example, the insulative value for outer skin may be greater than about 10 or 15 or 20 or even 100 or even about 200 R-value/inch to accomplish the goal of protecting the wearer from injury at a temperature of at least 700° F. for about at least 15 to 30 seconds. In one embodiment, the outer layer is protectively insulative to a temperature of at least at least 700° F. for a period of at least one second.

Figure 13:
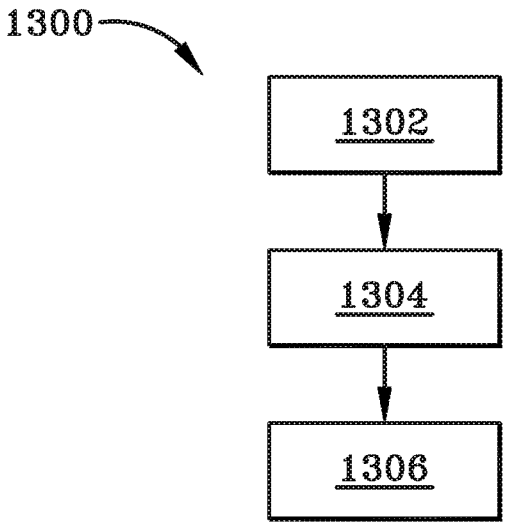
FIG. 13 is a flowchart of an exemplary method in accordance with one aspect of the present disclosure.

FIG. 13 depicts a method in accordance with the present disclosure generally at 1300. Providing a liquid-proof and heat-resistant glove 114 including the protective member 10 positioned beneath the outer layer 112, wherein the protective member 10 is a different color than the outer layer 112 is shown generally at 1302. Effecting the protective member 10 to be visually identified in response to rupturing the outer layer 112 is shown generally at 1304. Effecting the disposal of the glove based on the rupturing of the outer layer 112 identified by the different color of the protective member 10 is shown generally at 1306. In accordance with one aspect of the present disclosure, the method 1300 may further include where in effecting the protective member 10 to be visually identified in response to rupturing the outer layer 112 is accomplished by establishing a color splash effect against a darker backdrop created by the outer layer 112. Additionally, effecting the protective member 10 to be visually identified in response to rupturing the outer layer 112, it may be accomplished by establishing that the different color of the protective member 10 is lighter and brighter than the outer layer 112. In addition, method 1300 may include wherein rupturing the outer layer 112 occurs in response to drawing a spit 126 over the outer layer 112 in the thumb crotch region 104. Method 1300 may further include, wherein effecting the protective member to be visually identified in response to rupturing of the outer layer is accomplished by establishing that the different color of the protective member is lighter and brighter than the outer layer. Method 1300 may further include, wherein effecting the protective member to be visually identified in response to rupturing of the outer layer is accomplished by establishing a first color of the outer layer is the darkest color of any portion of the liquid proof and heat resistant glove. Method 1300 may further include, wherein effecting the protective member to be visually identified in response to rupturing of the outer layer is accomplished by establishing different color parameters between the first color and the second color. Method 1300 may further include, wherein effecting the protective member to be visually identified in response to rupturing of the outer layer is accomplished by establishing a lightness of the protective member is more than a lightness of the outer layer. Method 1300 may further include, wherein effecting the protective member to be visually identified in response to rupturing of the outer layer is accomplished by establishing a chrominance of the second color is farther away from dark chrominance than the first color. Method 1300 may further include, wherein effecting the protective member to be visually identified in response to rupturing of the outer layer is accomplished by establishing a hue associated with the protective member that is darker than a hue associated with the outer layer. Method 1300 may further include, wherein effecting the protective member to be visually identified in response to rupturing of the outer layer is accomplished by establishing reflective properties of the protective member.

Figure 14:
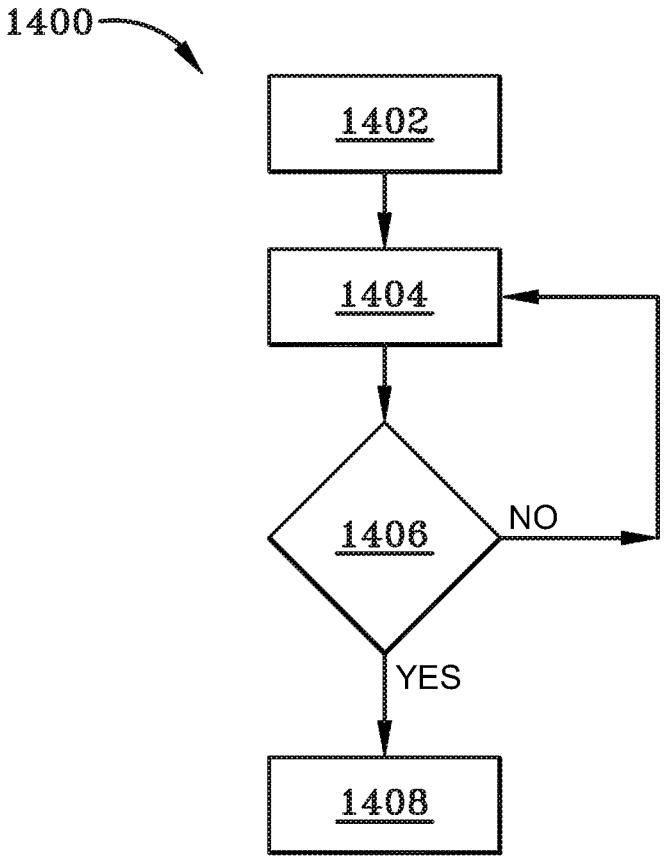
FIG. 14 is an exemplary flowchart in accordance with another aspect of the present disclosure.

FIG. 14 depicts another exemplary method in accordance with the present disclosure generally at 1400. Donning a liquid-proof and heat-resistant glove having a protective member 10 located in a thumb crotch region beneath an outer layer 112 of the glove is shown generally at 1402. Drawing an elongated member, such as spit 126, over the thumb crotch region is shown generally at 1404. Determining whether the outer layer 112 is damaged is shown generally at 1406. If it is determined that the glove is not damaged (i.e., "NO" path), then the glove may be reused and the method may continue to draw the elongated member (i.e., rotisserie spit 126) over the glove 114 at step 1404. The steps of 1404 and 1406 may be repeated indefinitely so long as the glove is not damaged, as determined at 1406. IN accordance with an aspect of the present disclosure, part of the determination at 1406 as to whether the glove is damaged requires visual inspect of a different color showing through a failure in the outer surface of the glove 114. If it is determined at 1406 that the glove is damaged (i.e., "YES" path), then the glove may be disposed. Disposing the glove in response to determining that the outer layer 112 is damaged is shown generally at 1408. Additionally, method 1400 may provide wherein determining whether the outer layer 112 is damaged is accomplished by viewing the protective member 10 through a break or rupture in the outer layer 112. Method 1400 may further provide wherein a portion of the protective member 10 is a different color than the outer layer 112. Method 1400 may further include wherein a protective member 10 is lighter and brighter in color than the outer layer 112 so as to allow the protective member 10 to be readily identifiable in the event of rupture. Method 1400 may further include wherein the protective member 10 is unable to be viewed when the outer layer 112 of the glove 114 is whole, uncut, unadulterated, and intact.

Figure 15:
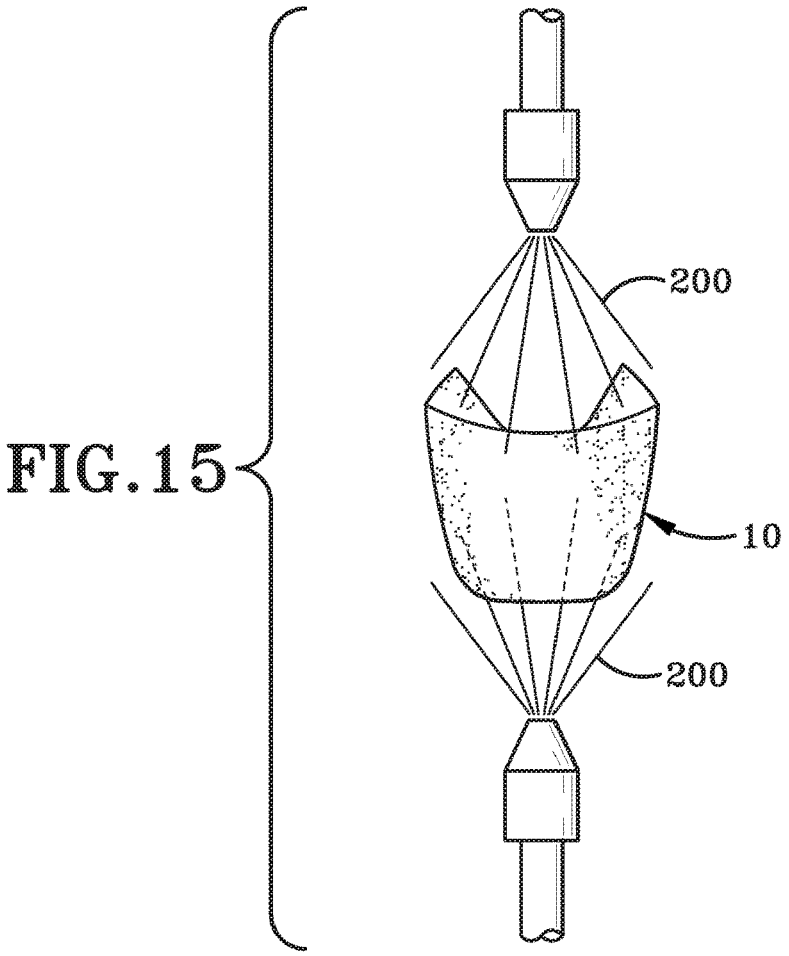
FIG. 15 is diagrammatic view of a protective member being painted or otherwise colored.

FIG. 15 represents an alternative embodiment in accordance with the present disclosure. FIG. 15 indicates that the protective member 10 may be painted in a manner so as to effectuate the color differential between the protective member 10 and the outer layer 112. In this particular example, the paint adhered to protective member 10 may substantially cover both the first surface 34 and the second surface 36. The paint applied by the sprayer effectuates a colored layer 200 when cured. Thus the paint shown in FIG. 15 generally at 200 represents its liquid form during the application process to protective member 10.

Figure 16:
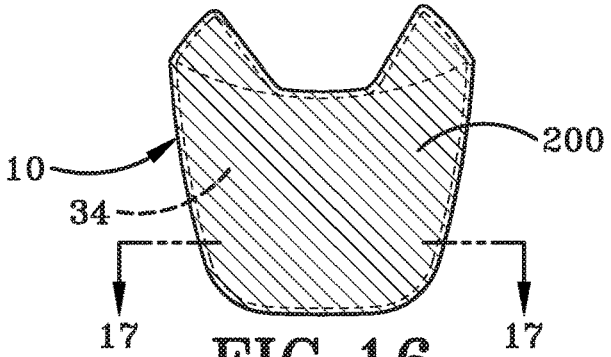
FIG. 16 is an elevation view of a painted or colored protective member.
Figure 17:
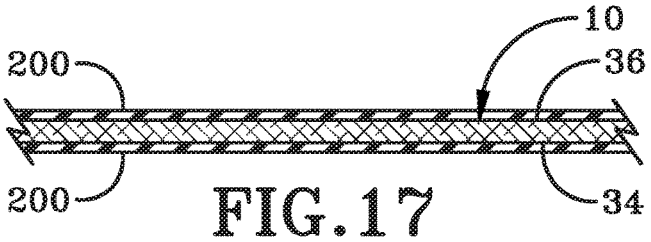
FIG. 17 is a cross-section taken along line 17-17 in FIG. 16.

As depicted in FIG. 16 and FIG. 17, a colored layer 200, which may be applied via the painting process depicted in FIG. 15, is located on both sides 34, 36 of protective member 10. The colored layer 200 may be a different color from the outer layer 112 as discussed above. The colored layer 200 may have the same or different coloring properties as the second color 120. In one particular embodiment, the colored layer 200, which may also be referred to as a third color 200, has differing properties from the protective member 10 itself. Similar to the second color 120, the third color 200 may effectuate the color splash effect in the event the glove is rupture. Thus, in keeping with the present disclosure, the color of the outer surface of the outer layer 112 is darker than the third color 200.

Figure 18:
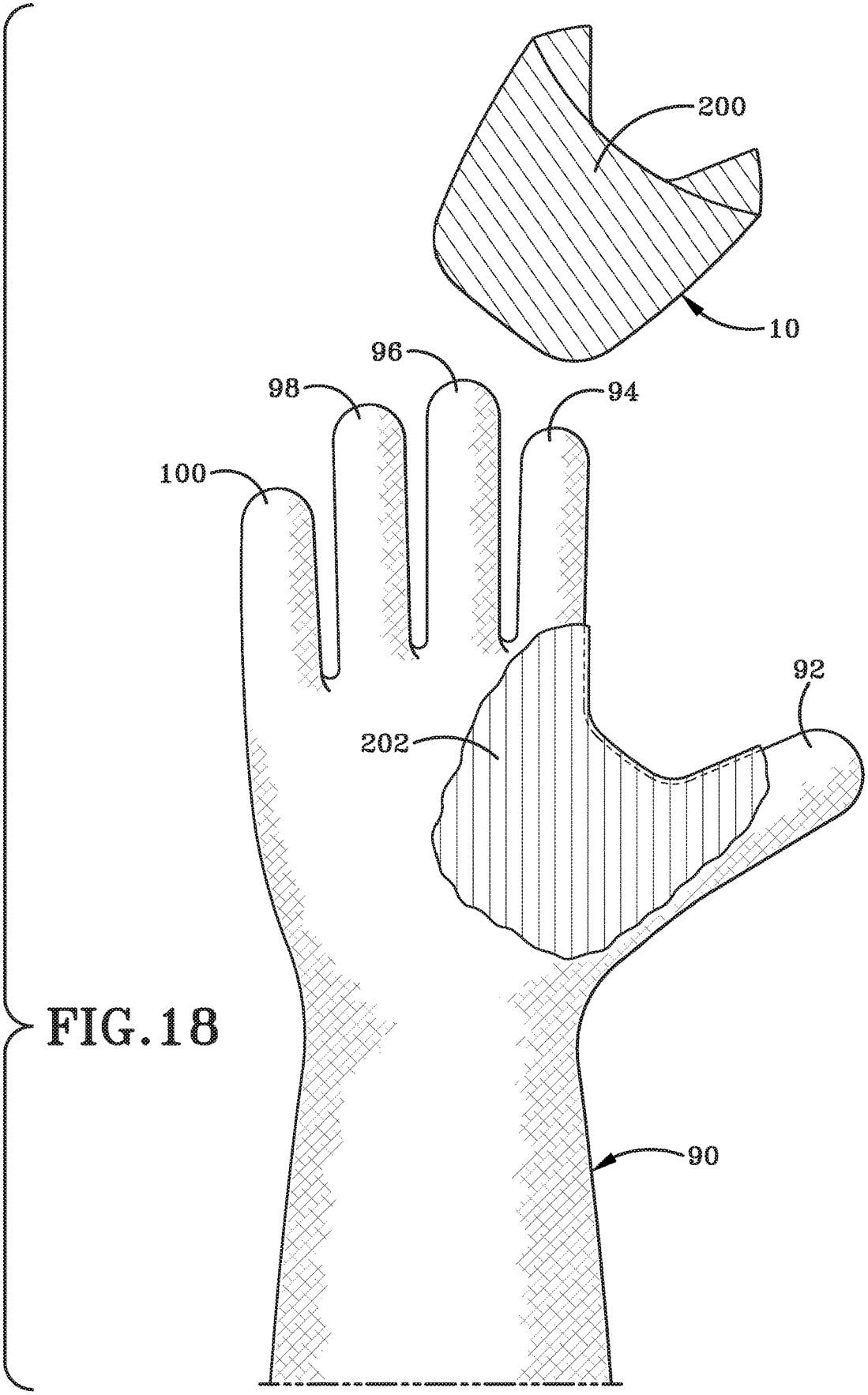
FIG. 18 is an exploded elevation view of a liner in a protective member, wherein the portion covering a thumb crotch region where the protective member will be installed is colored with a liquid-proof colored layer.

FIG. 18 depicts another embodiment of the present disclosure wherein a fourth colored layer 202, which is lighter in color than the outer layer 112 so as to effectuate the color splash effect in the event of rupture, is located beneath second surface 36 of protective member 10 and above the liner 90. The colored layer 202 may be applied in a conventionally known manner such as spraying, painting, brushing, or dipping. The colored layer 202 may be a liquid-proof paint when it cures. An exemplary colored layer 202 is a painted layer of substantially liquid impermeable polymers that are easily adhered to the liner 90. The colored layer 202 may be formed from a cured elastomeric material, such as liquid rubber or the like, that cures into a liquid impermeable solid or semi-solid after being applied in liquid form. Thus, colored layer 202 is additionally embodied as a sealant that has a color tint. As color layer 202 may be a sealant, the sealing effects (i.e., liquid impermeability) prevent fluid from penetrating to the interior of the glove beyond the inner liner. In one example, the colored layer may be formed from silicone to provide a durable, liquid-tight seal. When layer 202 is formed, at least partially, from silicone, the layer 202 may be tinted so as to accomplish the desired color splash effect inasmuch as silicone may sometimes be difficult to paint.

Figure 19:
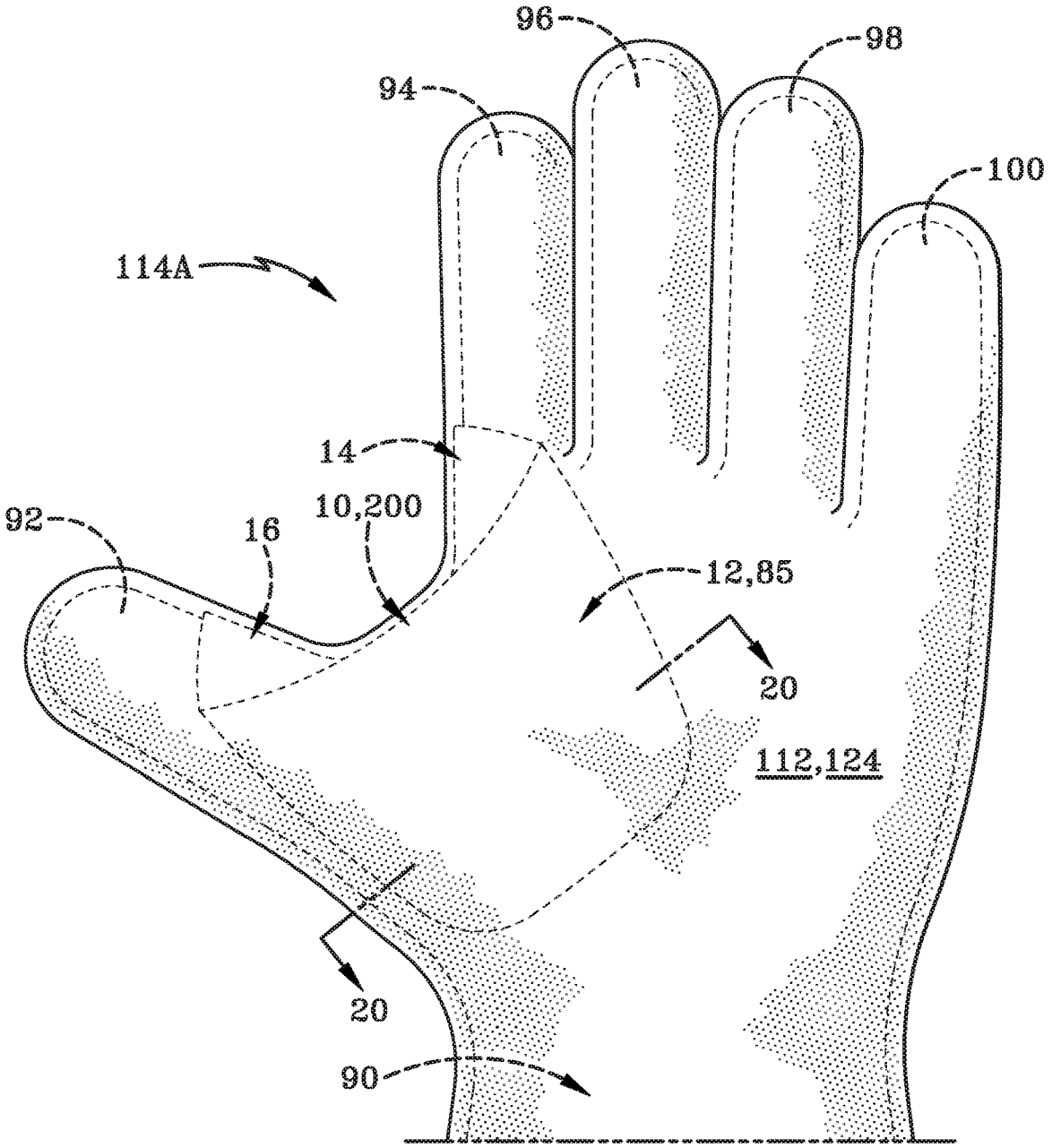
FIG. 19 is an enlarged palmar view of a left-hand glove having a colored layer below the protective member.
Figure 20:
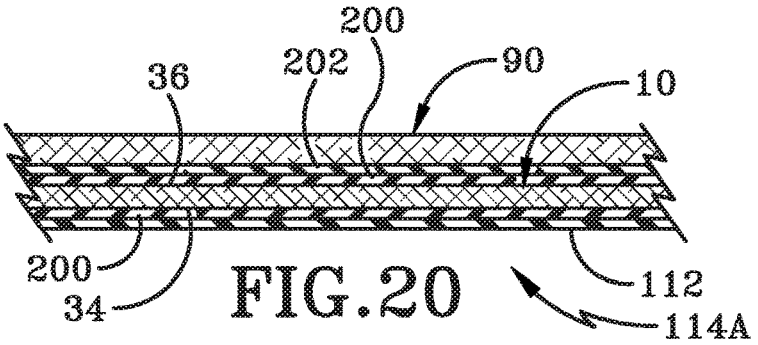
FIG. 20 is a cross-section view taken along line 20-20 in FIG. 19.
Figure 21:
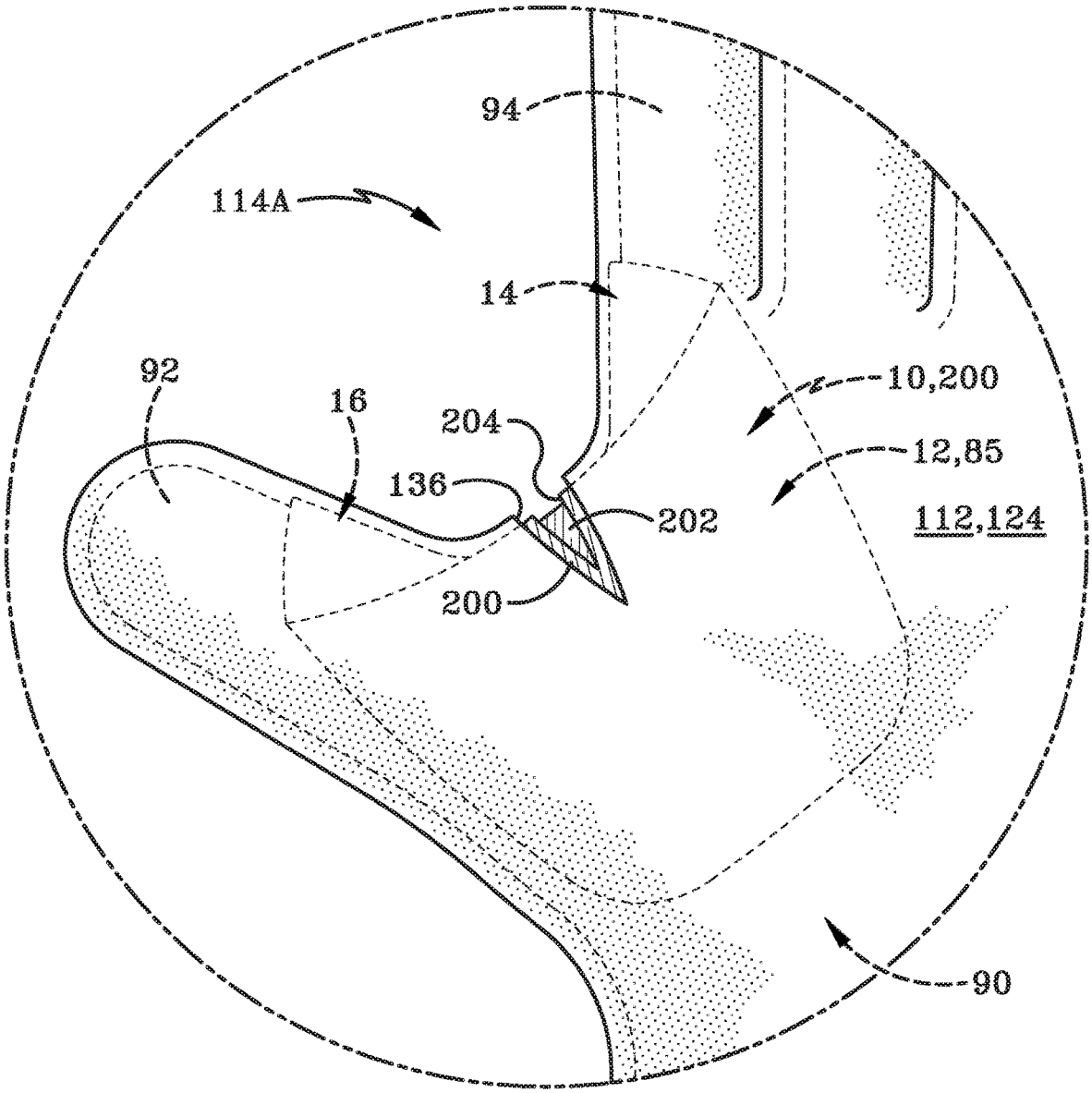
FIG. 21 is an enlarged palmar view of a glove having a collective rupture formed form a rupture in an outer layer and a rupture in the protective member establishing a color splash effect via a colored layer making itself visible through the secondary rupture in the protective member.

As depicted in FIGS. 19, 20, and 21, the purpose of the colored layer 202 is shown. When the rupture 136 occurs and a secondary rupture 204 of the protective member 10 occurs, then the colored layer 202 is seen through the rupture 136 in the outer layer 112 and seen through the rupture 204 in the protective member 10. Sometimes, the ruptures 136 and 204 may generally be referred to as a collective rupture or a collective failure in the glove. The colored layer 202 effectuates the color splash effect similar to those which have been described above. However, the substantially liquid impermeable polymers or elastomers or the like forming layer 202 enable the glove 114A to remain liquid proof. Thus, in the event that a wearer used the glove 114A in its dual purpose manner, liquids would not penetrate through the inner liner 90. The color splash effect of the colored layer 202 showing through secondary rupture 204 determines that the glove 114A needs to be discarded.

With continued reference to FIGS. 18-21, a method of use for the dual purpose glove includes donning the liquid proof and heat resistant glove 114A having a protective member 10 located in a thumb crotch region beneath the outer layer 112. Then, drawing an elongated member over the thumb crotch region. Then, determining whether the outer layer 112 is damaged (i.e., the rupture 136). Then, determining whether a protective member positioned beneath the outer layer is damaged (i.e., secondary rupture 204). Then, disposing the glove in response to determining that the protective member is damaged. In one example, determining whether the protective member is damaged is accomplished by viewing a colored layer through a break or rupture in the protective member. A portion of the colored layer is a different color than the protective member. The colored layer can be lighter and brighter in color than the protective member so as to allow the colored layer to be readily identifiable in the event of rupture. Generally, the colored layer is unable to be viewed when the protective member of the glove is whole, uncut, unadulterated, and intact. Additionally, the method may include submerging the thumb crotch region of the glove into a hot liquid contained by a cooking device in response to the determination that the protective member is not damaged regardless of whether the outer layer is damaged. Still further, the method can include submerging the thumb crotch region of the glove into heated liquid frying oil contained by a deep fryer. Drawing the elongated member over the thumb crotch region may be accomplished by a rotisserie spit moving over the outer layer of the glove. Then, removing poultry from the rotisserie spit while grasping the rotisserie spit with one hand and pulling the rotisserie spit with another hand. The step of removing poultry from the rotisserie spit while grasping the rotisserie spit with one hand and pulling the rotisserie spit with another hand may occur prior to submerging the thumb crotch region of the glove into heated frying oil contained by a deep fryer.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Additionally, the method of preforming the present disclosure may occur in a sequence different than those described herein. Accordingly, no sequence of the method should be read as a limitation unless explicitly stated. It is recognizable that performing some of the steps of the method in an different order could achieve a similar result.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the disclosure are an example and the disclosure is not limited to the exact details shown or described.

What is claimed:

1. A method comprising:

donning a liquid proof and heat resistant glove having a protective member located in a thumb crotch region beneath an outer layer;

drawing an elongated member over the thumb crotch region;

determining whether the outer layer is damaged;

determining whether a protective member positioned beneath the outer layer is damaged;

disposing the glove in response to determining that the protective member is damaged; and submerging the thumb crotch region of the glove into a hot liquid contained by a cooking device in response to the determination that the protective member is not damaged regardless of whether the outer layer is damaged.

2. The method of claim 1, wherein determining whether the protective member is damaged is accomplished by viewing a colored layer through a break or rupture in the protective member.

3. The method of claim 1, wherein a portion of the colored layer is a different color than the protective member.

4. The method of claim 3, wherein the colored layer is lighter and brighter in color than the protective member so as to allow the colored layer to be readily identifiable in the event of rupture.

5. The method of claim 1, wherein the colored layer is unable to be viewed when the protective member of the glove is whole, uncut, unadulterated, and intact.

6. The method of claim 1, further comprising:

submerging the thumb crotch region of the glove into heated liquid frying oil contained by a deep fryer.

7. The method of claim 1, wherein drawing the elongated member over the thumb crotch region is accomplished by a rotisserie spit moving over the outer layer of the glove.

8. A method comprising:

donning a liquid proof and heat resistant glove having a protective member located in a thumb crotch region beneath an outer layer;

drawing an elongated member over the thumb crotch region;

determining whether the outer layer is damaged;

determining whether a protective member positioned beneath the outer layer is damaged;

disposing the glove in response to determining that the protective member is damaged;

submerging the thumb crotch region of the glove into a hot liquid contained by a cooking device in response to the determination that the protective member is not damaged regardless of whether the outer layer is damaged;

submerging the thumb crotch region of the glove into heated liquid frying oil contained by a deep fryer.

9. The method of claim 8, wherein determining whether the protective member is damaged is accomplished by viewing a colored layer through a break or rupture in the protective member.

10. The method of claim 8, wherein a portion of the colored layer is a different color than the protective member.

11. The method of claim 10, wherein the colored layer is lighter and brighter in color than the protective member so as to allow the colored layer to be readily identifiable in the event of rupture.

12. The method of claim 8, wherein the colored layer is unable to be viewed when the protective member of the glove is whole, uncut, unadulterated, and intact.

13. The method of claim 8, wherein drawing the elongated member over the thumb crotch region is accomplished by a rotisserie spit moving over the outer layer of the glove.

* * * * *